US008472857B2

(12) United States Patent
Matsuno

(10) Patent No.: US 8,472,857 B2
(45) Date of Patent: Jun. 25, 2013

(54) IMAGE FORMING APPARATUS CONTAINING A RECORDING SHEET GUIDE MEMBER FOR BENDING THE RECORDING SHEET AT THE CENTER

(75) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 384 days.

(21) Appl. No.: 11/692,556

(22) Filed: Mar. 28, 2007

(65) Prior Publication Data

US 2007/0231032 A1 Oct. 4, 2007

(30) Foreign Application Priority Data

Mar. 28, 2006 (JP) ..... 2006-089097
Nov. 30, 2006 (JP) ..... 2006-323917

(51) Int. Cl.
*G03G 15/14* (2006.01)

(52) U.S. Cl.
USPC ..... 399/388; 399/406; 271/161

(58) Field of Classification Search
USPC ..... 399/388, 406; 271/209, 161, 188
See application file for complete search history.

(56) References Cited

U.S. PATENT DOCUMENTS 5,455,663 A 10/1995 Inoue et al.
5,740,512 A * 4/1998 Hayashi et al. ..... 399/316
5,923,938 A 7/1999 Enomoto et al.
5,933,697 A * 8/1999 Onodera et al. ..... 399/406
6,149,045 A * 11/2000 Kadono ..... 226/196.1
6,512,904 B2 * 1/2003 Sato et al. ..... 399/111
7,113,734 B2 * 9/2006 Deguchi et al. ..... 399/316
7,280,798 B2 * 10/2007 Yuminamochi ..... 399/390
7,556,260 B2 * 7/2009 Yoshimoto et al. ..... 271/188
2006/0002735 A1 1/2006 Tamaru et al.
2006/0067732 A1 3/2006 Igarashi
2006/0079358 A1 4/2006 Igarashi
2006/0180973 A1 8/2006 Igarashi
2007/0048005 A1 3/2007 Nakano
2007/0048006 A1 3/2007 Igarashi
2007/0048010 A1 3/2007 Nakano

FOREIGN PATENT DOCUMENTS

JP 54-106840 U 7/1979
JP 62-093154 4/1987
JP 1-081734 3/1989
JP 4-149569 5/1992
JP 5-011632 1/1993
JP 05193773 A * 8/1993

(Continued)

*Primary Examiner* — Matthew G Marini
(74) *Attorney, Agent, or Firm* — Banner & Witcoff, Ltd.

(57) ABSTRACT

According to an example structure, an image forming apparatus includes a belt having a conveying surface on which a recording sheet is conveyed; an image forming unit disposed opposite to the belt and forming an image on a surface of the recording sheet conveyed by the belt; a conveying unit conveying the recording sheet onto the belt; and a guiding member disposed opposite to the conveying surface of the belt and configured to at least partly guide the recording sheet toward the conveying surface of the belt while the guiding member comes into contact with a first back surface opposite to a surface of which the recording sheet comes into contact with the conveying surface of the belt. The recording sheet is guided by the guiding member while being bent at a center of tip end portion with respect to a width direction orthogonal to a conveying direction of the recording sheet so as to protrude toward the conveying surface of the belt.

19 Claims, 21 Drawing Sheets

FOREIGN PATENT DOCUMENTS

| | | |
|---|---|---|
| JP | 6-274049 | 9/1994 |
| JP | 9-175685 | 7/1997 |
| JP | 10-142960 | 5/1998 |
| JP | 11-349182 | 12/1999 |
| JP | 2005-084329 | 3/2005 |
| JP | 2006-096527 | 4/2006 |
| JP | 2006-126661 | 5/2006 |

* cited by examiner

IMAGE FORMING APPARATUS CONTAINING A RECORDING SHEET GUIDE MEMBER FOR BENDING THE RECORDING SHEET AT THE CENTER

CROSS-REFERENCE TO RELATED APPLICATIONS

This application is based on and claims the benefit of priority from the prior Japanese Patent Applications No. 2006-089097, filed on Mar. 28, 2006 and No. 2006-323917, filed on Nov. 30, 2006; the entire contents of which are incorporated herein by reference.

TECHNICAL FIELD

An aspect of the present invention relates to an image forming apparatus, more specifically relates to a technique for guiding a recording sheet onto a belt that conveys a recording sheet in the image forming apparatus.

BACKGROUND

As an image forming apparatus, there is known one including a belt for conveying a recording sheet and an image forming unit which is disposed so as to face a conveying surface of the belt and forms an image on the surface of a recording sheet conveyed by the belt.

In such an image forming apparatus, when a recording sheet fed from the upstream side of the recording sheet conveying direction of the belt comes into contact with the belt, air may be trapped between the recording sheet and the conveying surface of the belt and the recording sheet may partially float from the conveying surface of the belt. If the recording sheet is conveyed in this state to the image forming unit and an image is formed on the surface thereof, the quality of the formed image may lower.

For example, in an electrophotographic image forming apparatus, the image forming unit is configured by a photosensitive member, and a recording sheet is conveyed between the photosensitive member and the conveying surface of the belt, and a transfer bias is applied to a transfer unit and a developing image is transferred (formed) onto the surface of the recording sheet. However, when the transfer is performed in a state that the recording sheet floats from the conveying surface of the belt, there is a possibility that the transfer bias is not sufficiently applied to the floating portion and a so-called void where a developing image is not transferred occurs there, and the image quality lowers.

Therefore, a guiding member is provided which is disposed at an upstream side of the belt in the recording sheet conveying direction; and the guiding member comes into contact with a surface of a recording sheet facing the conveying surface of the belt and guides the tip end portion of the recording sheet to the belt while curving a central portion of the recording sheet in the width direction orthogonal to the conveying direction of the recording sheet so as to protrude toward the conveying surface of the belt.

By the above-described configuration, when a recording sheet is guided by the guiding member while being curved, the recording sheet can be guided to the belt so that, first, the widthwise central portion of the recording sheet curved and protruded toward the conveying surface side comes into contact with the conveying surface of the belt, and while being conveyed, the contact area gradually spreads toward both end sides in the width direction of the recording sheet and air between the conveying surface of the belt and the recording sheet is expelled to both ends. Thus, by expelling air trapped between the recording sheet and the conveying surface of the belt to both end sides, air can be prevented from being trapped between the recording sheet and the conveying surface of the belt and partially floating the recording sheet from the conveying surface of the belt and lowering the image quality.

SUMMARY

However, according to the above-described related art, the guiding member is in contact with a surface of a recording sheet facing the conveying surface of the belt, so that a tip end portion of the recording sheet may warp in a direction of separating from the conveying surface of the belt due to a drag from the guiding member. In addition, when the recording sheet comes into contact with the guiding member in a state that the tip end portion of the recording sheet is curled so as to separate from the conveying surface of the belt, the recording sheet warps more from the conveying surface of the belt. When the recording sheet comes into contact with the belt in a state that the tip end thereof thus warps from the conveying surface of the belt, the tip end portion of the recording sheet does not come into close contact with the conveying surface of the belt and floats therefrom, and air may be trapped between the recording sheet and the conveying surface and lowers the image quality.

The present invention has been made in view of the above circumstances and provides an image forming apparatus. According to an aspect of the invention, there is provided an image forming apparatus capable of preventing a lowering in image quality.

According to another aspect of the invention, an image forming apparatus including: a belt having a conveying surface on which a recording sheet is conveyed; an image forming unit disposed opposite to the belt, the image forming unit forming an image on a surface of the recording sheet conveyed by the belt; a conveying unit conveying the recording sheet onto the belt; and a guiding member disposed opposite to the conveying surface of the belt and configured to at least partly guide the recording sheet toward the conveying surface of the belt while the guiding member comes into contact with a first back surface opposite to a surface of which the recording sheet comes into contact with the conveying surface of the belt, the recording sheet being guided by the guiding member while the recording sheet is bent at a center of tip end portion thereof with respect to a width direction orthogonal to a conveying direction of the recording sheet so as to protrude toward the conveying surface of the belt.

BRIEF DESCRIPTION OF THE DRAWINGS

In the accompanying drawings.

DESCRIPTION OF THE EXAMPLE STRUCTURES

Hereinafter, "elasticity" in the recording sheet means a level of the elastic force of the recording sheet, or difficulty in deformation. The recording sheet being high in elasticity is hardly creased.

Next, an example structure of the invention will be described with reference to FIG. 1 through FIG. 9.

Figure 1:
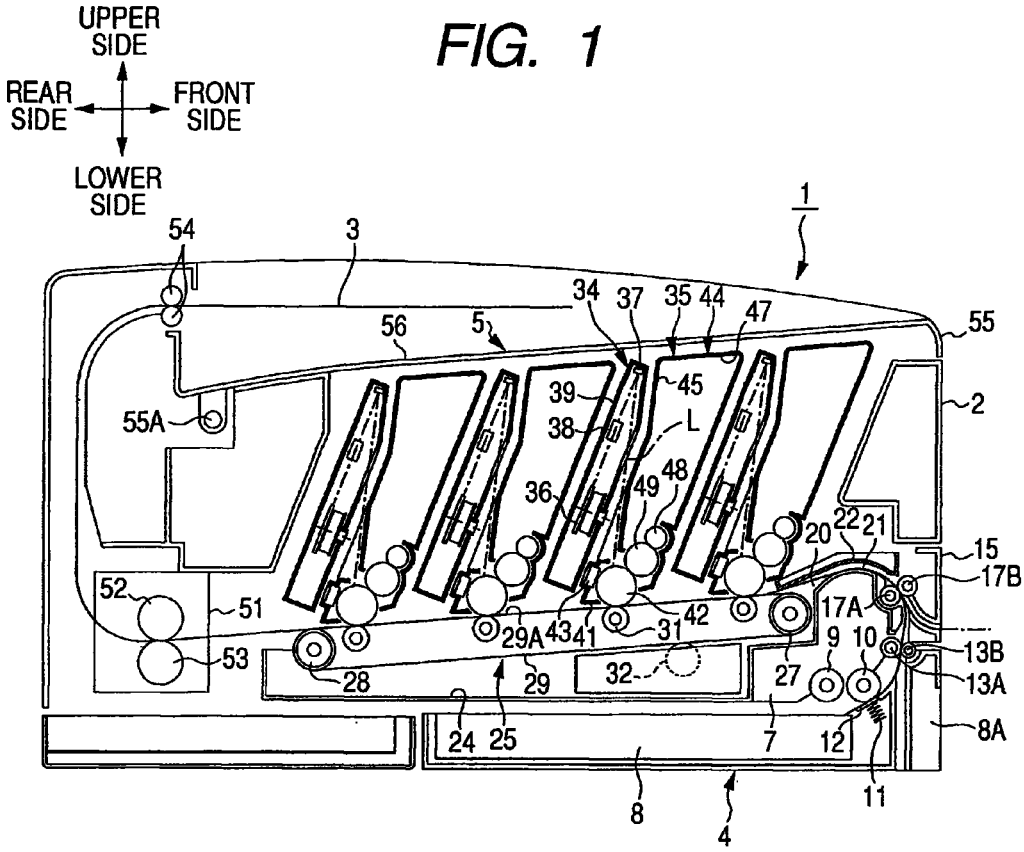
FIG. 1 is an exemplary sectional side view showing a general construction of a laser printer according to an example structure of the image forming apparatus.

A laser printer 1 is a direct tandem color laser printer including photosensitive drums 42 as an example of four photosensitive members corresponding to the colors of black, cyan, magenta, and yellow. The laser printer 1 includes, in the main body casing 2, a conveying unit 4 conveying a sheet 3 as an example of the recording sheet, an image forming unit 5 as an example of the image forming unit for forming an image on the sheet 3 conveyed by the conveying unit 4, and so on. In the following description, the right side with respect to the paper surface of FIG. 1 is defined as "front side," the left side with respect to the paper surface is defined as "rear side," the upper side with respect to the paper surface is defined as "upper side," and the lower side with respect to the paper surface is defined as "lower side."

Figure 2:
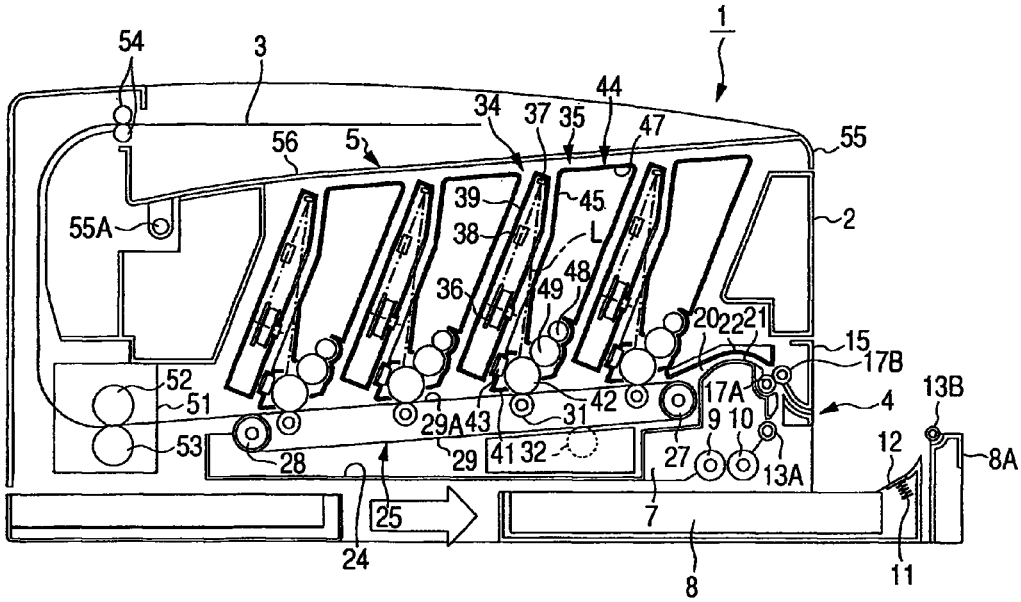
FIG. 2 is an exemplary sectional side view showing a state that a paper feeding tray is drawn out of the main body casing.

The conveying unit 4 is provided in the lower side of the main body casing 2. The conveying unit 4 can be drawn forward from the main body casing 2. The conveying unit 4 has a unit frame 7. Under the unit frame 7, a shallow-tray-shaped paper feeding tray 8 in which sheets 3 to be fed to the image forming unit 5 can be stacked is detachably attached to the unit frame 7. A front wall 8A is provided on the front end of the paper feeding tray 8. The front wall 8A is disposed at the lowest position of the front surface of the main body casing 2. By drawing the front wall 8A forward, as shown in FIG. 2, the paper feeding tray 8 can be detached from the unit frame 7 and independently drawn forward of the main body casing 2.

A paper presser (not shown) is provided on the bottom surface of the paper feeding tray 8. The paper presser can tilt so as to lift the front end side. A pickup roller 9 held by the unit frame 7 is provided at a front end upper position of the paper feeding tray 8. A paper feed roller 10 held by the unit frame 7 is provided in front of the front end upper position of the paper feeding tray 8. A separating pad 12 is provided on the front side of the paper feeding tray 8. The separating pad 12 is brought into contact with the paper feed roller 10 by an urging force of a spring 11. A pair of paper dust removing rollers 13A and 13B are provided on a diagonally upper front side of the paper feed roller 10. One paper dust removing roller 13A is attached to the unit frame 7, and the other paper dust removing roller 13B is attached to an upper end of the back surface of the front wall 8A of the paper feeding tray 8.

A sheet 3 at the top in the paper feeding tray 8 is pressed against the pickup roller 9 by an urging force of the paper presser, and the sheet 3 is conveyed between the paper feed roller 10 and the separating pad 12 by rotation of the pickup roller 9. The sheet 3 is separated alone when sandwiched between the paper feed roller 10 and the separating pad 12 and fed to the diagonally upper front side. Paper dust is removed from the sheet 3 by the pair of paper dust removing rollers 13A and 13B, and then the sheet 3 is conveyed to resist rollers 17A and 17B serving as conveying rollers through a tray side paper feed path 19 (see FIG. 6) formed substantially upward from the paper dust removing rollers 13A and 1B. The conveying unit is configured by, for example, the resist rollers 17A and 17B and a guide member described later.

Figure 3:
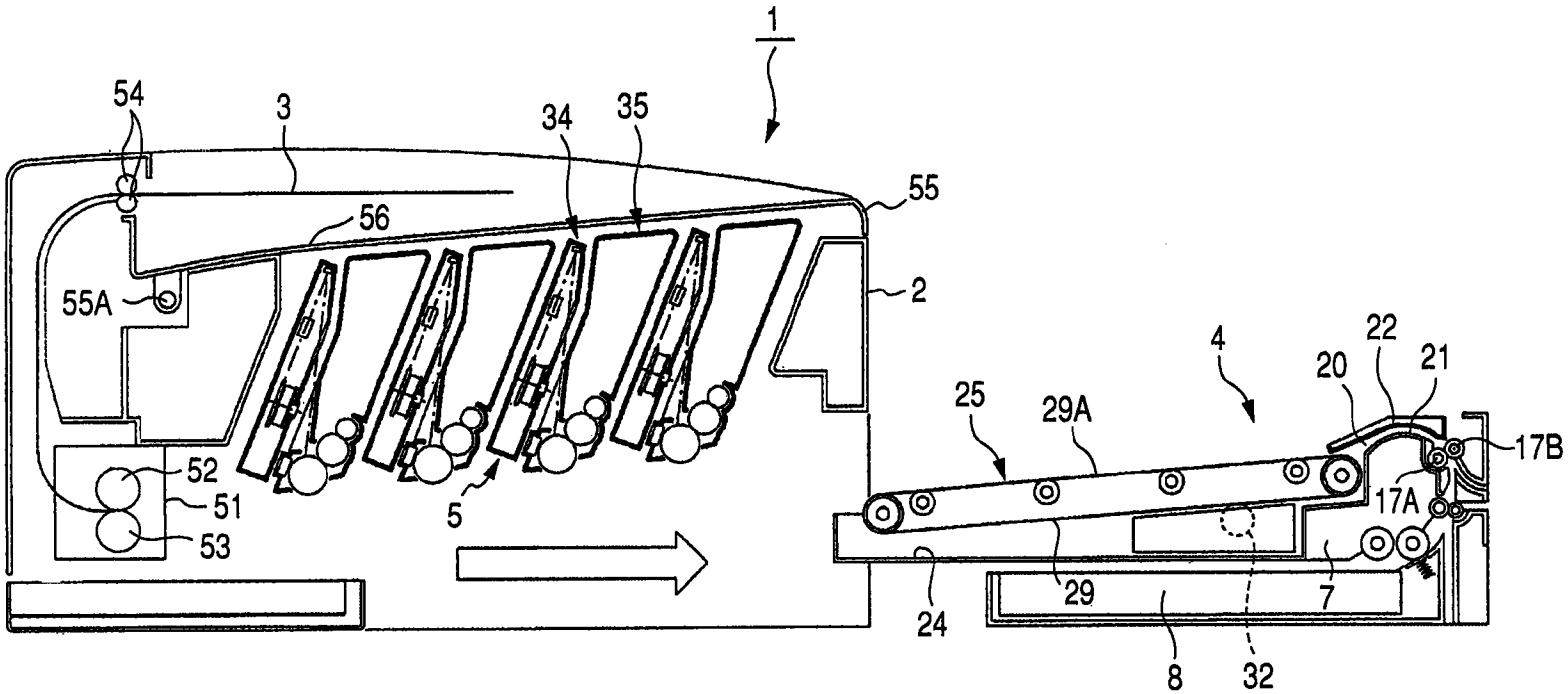
FIG. 3 is an exemplary sectional side view showing a state that the conveying unit is drawn out of the main body casing.

On the front end portion of the conveying unit 4, a front wall 15 is provided so as to continuously flush with the front face of the main body casing 2 and the front wall 8A of the paper feeding tray 8. The conveying unit 4 can be entirely drawn forward from the main body casing 2 as shown in FIG. 3 by drawing the front wall 15 forward. In a lower portion of the front wall 15, a manual paper feed port 18A (see FIG. 6) through which the sheet 3 to be manually fed can be inserted is opened. On the inner side of the front wall 15, a pair of resist rollers 17A and 17B serving as the conveying rollers are provided. A manual feed side paper feed path 18 (see FIG. 6) continued from the manual paper feed port 18A and a tray side paper feed path 19 extending substantially upward from the paper dust removing rollers 13A and 13B join at a position immediately before the resist rollers 17A and 17B. On the resist rollers 17A and 17B, a sheet 3 fed from both paper feed paths 18 and 19 is subjected to skew correction, and then fed to the upper surface of the belt 29 through the paper feed path 20. The paper feed path 20 is constructed between an inner guide member 21 formed integrally on the upper surface of the unit frame 7 and a guide member 22 attached so as to face said guide member 2 at a higher position, and the paper feed path is curved so as to be convex upward as a whole. The guide member 22 and other elements around the guide member 22 will be described in detail later.

The unit frame 7 has a tray-shaped belt unit attaching part 24 opened upward at a rear position of the inner guide member 21, and a belt unit 25 detachably attached thereto. The belt unit 25 has a box-shaped belt frame 26 opened upward (see FIG. 6, not shown in FIG. 1 through FIG. 5), and the respective parts of the belt unit 25 are housed inside the belt frame. The belt unit 25 has a pair of belt support rollers 27 and 28 disposed in parallel while spaced forward and rearward from each other and a belt 29 laid across the belt support rollers 27 and 28. The belt moves by a rotation of the rear-side belt support roller 28 driven by a motor (not shown). The front-side belt support roller 27 is in a position slightly higher than the rear-side belt support roller 28. The conveying surface 29A (upper surface) of the belt 29 on which the sheet 3 is conveyed is inclined slightly downward toward the rear end more than the horizontal direction. On the inner side of the belt 29, four transfer units disposed so as to face the respective photosensitive drums 42 of process cartridges 35 (described later) and transfer rollers 31 serving as an electrostatic adsorbing unit are provided in line at predetermined intervals in the front and rear direction. The belt 29 is sandwiched between the photosensitive drums 42 and the corresponding transfer rollers 31. A cleaning roller 32 cleaning remaining toner adhering to the surface of the belt 29 is provided under the belt 29. The sheet 3 fed out from the resist rollers 17A and 17B passes through the paper feed path 20 and comes into contact with the vicinity of the front end of the conveying surface 29A of the belt 29. The sheet is electrostatically adsorbed by the conveying surface 29A of the belt 29 due to a transfer bias applied to the transfer roller 31 and conveyed rearward according to rotation of the belt 29.

An image forming unit 5 is provided above the belt unit 25 inside the main body casing 2. Four Scanners 34 serving as the exposing unit and four process cartridges 35 forming images in magenta, yellow, cyan, and black are arranged alternately in the front and rear direction. The scanner 34 houses inside a scanner case 39 a polygon mirror 36 reflecting a laser beam L emitted from a laser diode (not shown) so as to successively change its direction along a predetermined surface, a turning mirror 37 turning the laser beam L reflected by the polygon mirror 36 toward the photosensitive drum 42 of the process cartridge 35, and an fθ lens 38 provided in the light path of the laser beam L. Each scanner case 39 has a substantially plate-like external form, and each scanner case 39 is attached in an inclined posture so that its upper end side turns forward.

The process cartridge 35 has a photosensitive drum 42 and a scorotron charger 43. The photosensitive drum 42 is rotatably provided with the process cartridge 35 on the lower side of the frame-shaped cartridge frame 41. The scorotron charger 43 for evenly charging the surface of the photosensitive drum 42 is provided around the photosensitive drum 42. A developing cartridge 44 serving as the developing unit is detachably attached to the cartridge frame 41. The developing cartridge 44 has a substantially box-shaped case 45 opened downward. The case 45 is attached in an inclined posture so that its upper end side turns forward. A toner containing chamber 47 containing toner in each color as a developer is formed on the upper side of the inside of the case 45. Inside the toner containing chamber 47, an agitator (not shown) for agitating the toner is rotatably provided. A supply roller 48, a developing roller 49 and a layer thickness restricting blade (not shown) are provided on the lower side of the toner containing chamber 47 inside the case 45. The process cartridge 35 is detachable from the main body casing 2. The process cartridge 35 is detached to the diagonally upper front side from the main body casing 2 and attached in the opposite direction.

Toner released from the toner containing chamber 47 is supplied to the developing roller 49 by rotation of the supply roller 48, and at this time, frictionally positively charged between the supply roller 48 and the developing roller 49. The toner supplied onto the developing roller 49 enters between the tip end of the layer thickness restricting blade and the developing roller 49 in accordance with rotation of the developing roller 49, and carried on the developing roller 49 as a thin film with a fixed thickness. The surface of the photosensitive drum 42 is evenly positively charged by the scorotron charger 43 in accordance with its rotation, and then exposed by high-speed scanning of a laser beam L from the scanner 34, and an electrostatic latent image corresponding to an image to be formed on the sheet 3 is formed.

Next, by rotation of the developing roller 49, when the toner carried on the developing roller 49 and positively charged faces and comes into contact with the photosensitive drum 42, the toner is supplied to the electrostatic latent image formed on the surface of the photosensitive drum 42. Accordingly, the electrostatic latent image on the photosensitive drum 42 is visualized, and a toner image formed by reversal development is carried on the surface of the photosensitive drum 42.

Thereafter, toner images carried on the surfaces of the respective photosensitive drums 42 are successively transferred onto the sheet 3 due to a transfer bias applied to the transfer rollers 31 during passing of the sheet 3 conveyed by the belt 29 through transfer positions between the photosensitive drums 42 and the transfer rollers 31. The sheet 3 on which toner images are transferred is conveyed to a fixing device 51.

Figure 4:
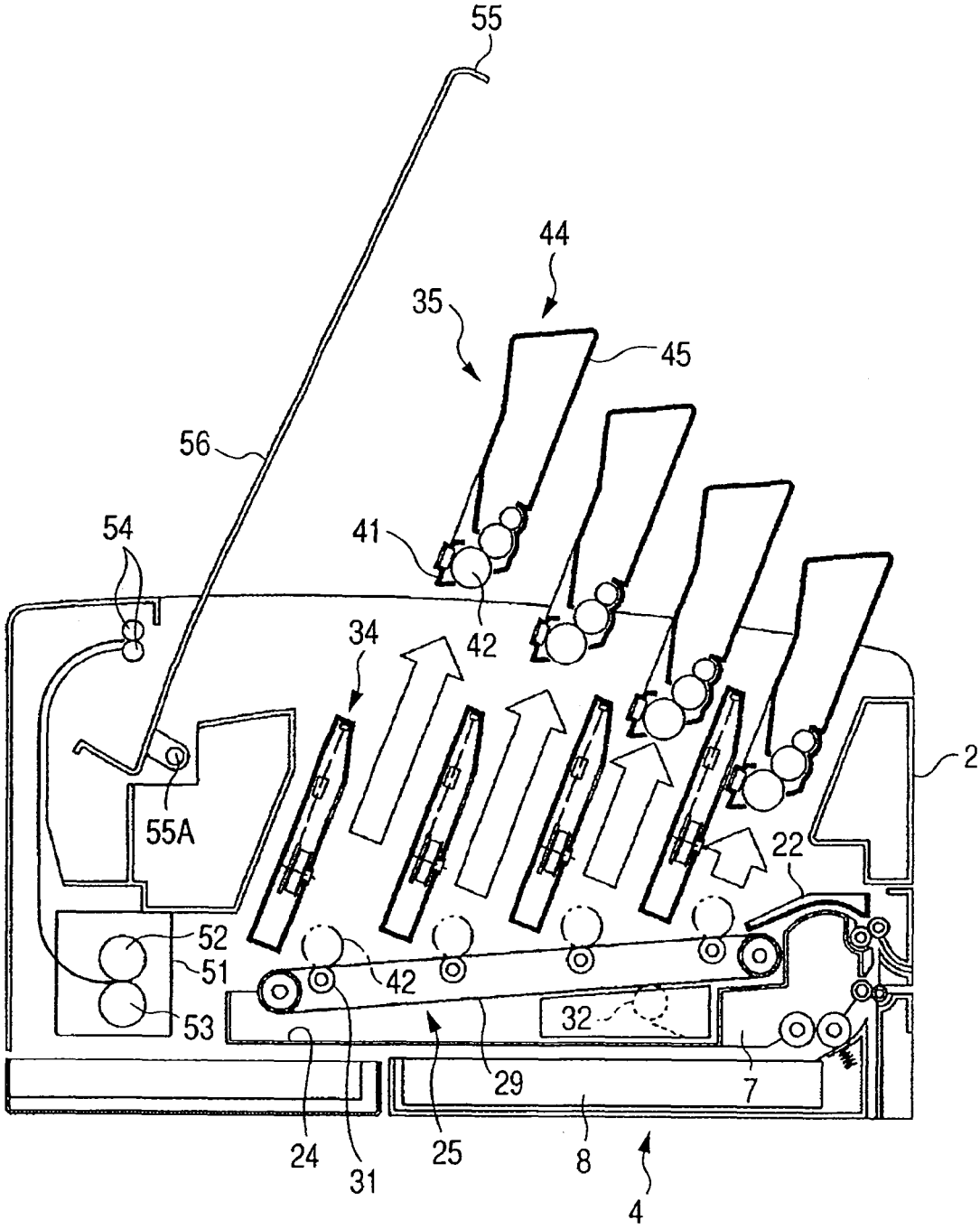
FIG. 4 is an exemplary sectional side view showing a state that a cover is opened.

The fixing device 51 is disposed on the rear side of the belt 29 in the main body casing. The fixing device 51 includes a heating roller 52 and a pressurizing roller 53, etc., disposed facing each other, and heat-fix the toner images transferred on the sheet 3 to the sheet surface. The heat-fixed sheet 3 is conveyed to an eject roller 54 provided on the upper side of the main body casing 2 while U-turned back. On the upper surface of the main body casing 2, a cover 55 which can open and close around a hinge 55A is provided, and the upper surface of the cover 55 is formed into a discharge tray 56 in which image-formed sheets 3 ejected from the eject roller 54 are stacked. By opening this cover 55, as shown in FIG. 4, each process cartridge 35 becomes exchangeable.

As described above, in the laser printer 1, in order from the lower side, in the main body casing 2, the paper feeding tray 8, the belt unit 25, the image forming unit 5, and the discharge tray 56 on the upper surface of the main body casing 2 are stacked vertically, and a so-called S-shaped conveying path is formed in which a sheet fed out forward from the paper feeding tray 8 is conveyed rearward on the belt 29 by being U-turned and further turned back again and reaches the discharge tray 8 on the upper surface.

Next, the guide member 22 and the periphery thereof in the conveying unit 4 will be described in greater detail with reference to FIG. 6 and FIG. 7.

Figure 7:
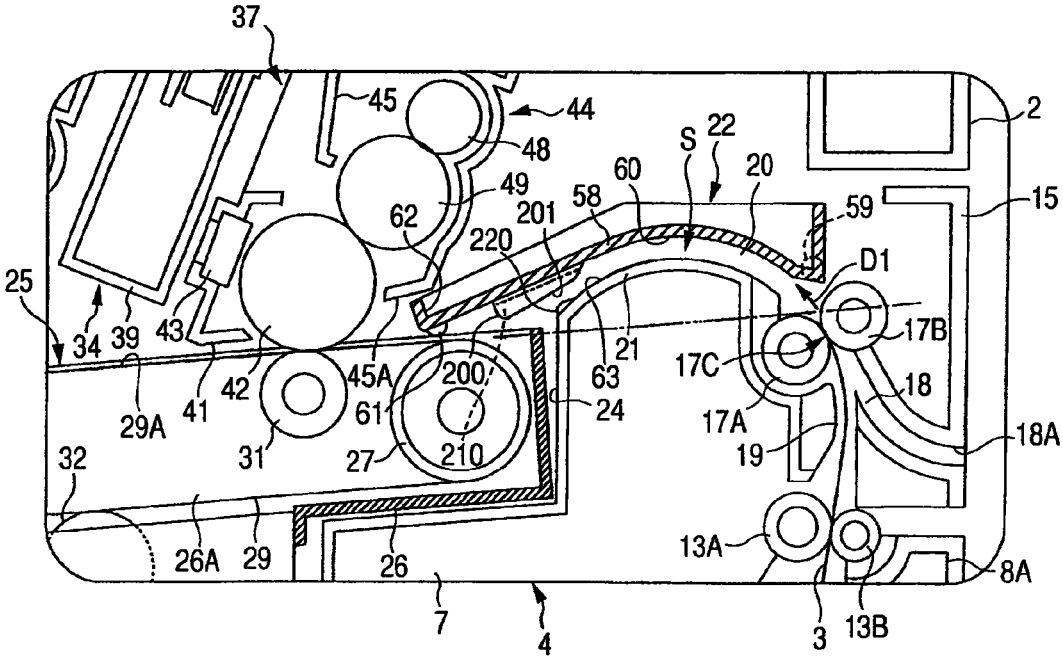
FIG. 7 is an enlarged sectional side view of the vicinity of the guide member.

The pair of resist rollers 17A and 17B are equal in outer diameter to each other, and the nipping position 17C of the resist rollers 17A and 17B is positioned near the extension of the conveying surface 29A of the belt 29 (see FIG. 7). The front-side resist roller 17B is positioned slightly higher than the rear-side resist roller 17A, and an angle A between a line connecting the central axes of the resist rollers 17A and 17B and the horizontal axis is set in a range of 0 degrees<A<90 degrees. That is, a feed-out direction D1 of the sheet 3 from the resist rollers 17A and 17B (direction orthogonal to the line connecting the central axes) is inclined diagonally upward to the belt 29 side with respect to the vertical axis. The above-described manual feed side paper feed path 18 is horizontal near the manual paper feed port 18A, that is, the inserting direction D2 of the sheet 3 into the manual feed side paper feed path 18 extends rearward almost horizontally. The manual feed side paper feed path 18 is curved to the diagonally upper rear side so that its angle becomes closer to the feed-out direction D1 of the sheet 3 from the resist rollers 17A a 17B toward the downstream side from the manual paper feed port 18A. A feed-out direction D3 of the sheet 3 from the pair of paper dust removing rollers 13A and 13B to the tray side paper feed path 19 (direction orthogonal to a line connecting the central axes of the paper dust removing rollers 13A and 13B) is slightly inclined to the diagonally-upper front side more than the vertical direction. The tray side paper feed path 19 is slightly curved to the diagonally upper rear side so that it has an angle that becomes closer to the feed-out direction D1 of the sheet 3 from the resist rollers 17A and 17B toward the downstream side. The feed-out direction D1 of the sheet 3 from the resist rollers 17A and 17B is a direction in the middle of the sheet inserting direction D2 into the manual feed side paper feed path 18 and the feed-out direction D3 of the sheet 3 from the paper dust removing rollers 13A and 13B, so that curves of sheets 3 passing through the paper feed paths 18 and 19 are both reduced. Therefore, with this construction, even when the apparatus is downsized, curvature of a sheet 3 in each of the paper feed path 18 or 19 is reduced, and therefore, loads on the sheet 3 or the resist rollers 17A and 17B, etc., can be suppressed.

The feed-out direction D1 of the sheet 3 from the resist rollers 17A and 17B is inclined toward the conveying direction of the sheet 3 on the conveying surface 29A more than a direction orthogonal to the conveying surface 29A of the belt 29. Herein, In case that the feed-out direction D1 of the sheet 3 from the resist rollers 17A and 17B is set to be orthogonal to the conveying surface 29A, the curvature of the sheet 3 in the paper feed path 20 increases. When the feed-out direction D1 of the sheet 3 from the resist rollers 17A and 17B is set to be parallel to the conveying surface 29A, if the sheet 3 tries to curve by a predetermined amount, the curvature at the curved portion of the sheet 3 also increases. In comparison with the cases, according to the example structure of the invention, the curve (curvature) of the sheet 3 in the paper feed path 20 can be reduced. Therefore, with this construction, even when the apparatus is reduced size, the curvature of the sheet 3 in the paper feed path 20 can be reduced, and therefore, loads on the sheet 3, the resist rollers 17A and 17B, and the belt 29, etc., can be suppressed.

The guide member 22 is made of a synthetic resin material, and the guide member 22 has a plate-shaped part 58 facing the paper feed path 20. The width of this plate-shaped part 58 is set to be equivalent to that of the belt frame 26 of the belt unit 25. On the front end lower part of the guide member 22, a pair of shafts 59 are projected on both left and right sides (both sides in the width direction), and each shaft 59 is held by a bearing (not shown) provided on the unit frame 7 side. The guide member 22 is attached to be rotatable around the shafts 59. On the lower surface of the plate-shaped part 58, a guide surface 60 which the tip end portion of a sheet 3 fed out from the resist rollers 17A and 17B can come into rubbing contact with is formed. This guide surface 60 is formed into a concave shape so that from the upstream side to the downstream side in the sheet conveying direction, it gradually separates from the conveying surface 29A, and then gradually approaches the conveying surface 29A in the direction orthogonal to the conveying surface 29A. On the downstream side end of the plate-shaped part 58, positioning protrusions 61 are projectedly provided downward from both left and right ends, and by bringing the tip end portions of the positioning protrusions 61 into contact with the upper end face of the side wall 26A of the belt frame 26, the downstream side end of the guide member 22 is positioned. On the downstream side end of the plate-shaped part 58, a reinforcement edge 62 extending almost orthogonally to the plate-shaped part 58 is formed across the entire width on the opposite surface side of the guide surface 60. Thereby, the strength of the belt 29 side of the guide member 22 is secured.

Above the belt 29, a lower end 45A of the case 45 of the above-described process cartridge 35 is disposed so as to face the conveying surface 29A of the belt 29, and the downstream side end of the guide member 22 enters between the lower end 45A of the case 45 and the conveying surface 29A. The downstream side end of the guide member 22 is restricted by the lower end 45A of the case 45 from being displaced upward.

On the inner side of the belt 29, a transfer roller 31 for subsequent transfer of a first color is disposed on the downstream side of the front-side belt support roller 27 (belt support roller closest to the guide member). The belt side end of the guide member 22 is disposed at a position more downstream than the supporting position of the belt support roller 27 on the conveying surface 29A of the belt 29 while slightly spaced from the conveying surface 29A. The conveying speed Vr (almost equal to the peripheral velocity of the resist rollers 17A and 17B) of the sheet 3 conveyed by the resist rollers 17A and 17B has a relationship of Vr>Vb with the conveying speed Vb (almost equal to the moving speed of the belt 29) of the sheet 3 by the belt 29.

The inner guide member 21 is formed integrally with the front side upper surface of the unit frame 7, and the inner guide member 21 has a convex guide surface 63 which the sheet 3 can come into rubbing contact with and is curved into a convex shape so as to face the guide surface 60. Protrusion ribs 200 serving as the guiding member is integrally fixed with the guide member 22, and the protrusion ribs 200 are disposed adjacent to the downstream side end of the guide surface 60 and disposed opposite to the conveying surface 29A of the belt 29.

Two protrusion ribs 200 are projected so as to come into contact with a conveyed sheet 3 at positions facing a width direction central portion of the guide member 22, that is, a width direction central portion of the conveyed sheet 3.

On both sides in the width direction of the protrusion ribs 200, a plurality of guide ribs 210 protruded by a protrusion amount smaller than that of the protrusion ribs 200 are fixed to the guide member 22.

Figure 6:
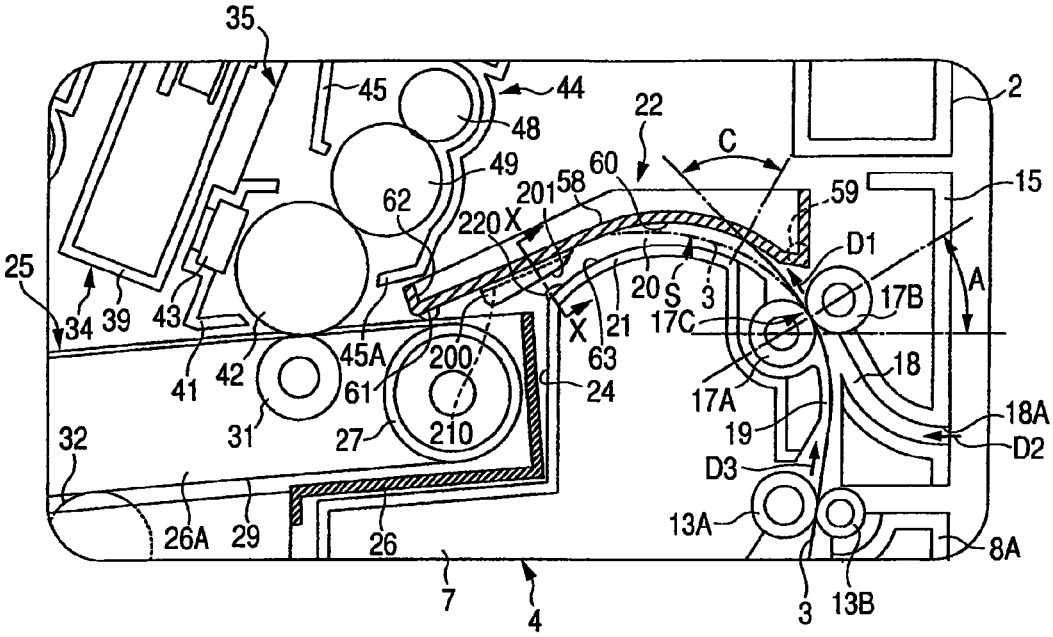
FIG. 6 is an exemplary enlarged sectional side view of the vicinity of the guide member.

The tip end portions 201 of the protrusion ribs 200 are inclined so as to gradually increase their protrusion amounts from the upstream side to the downstream side as shown in FIG. 6 and FIG. 7.

Figure 8:
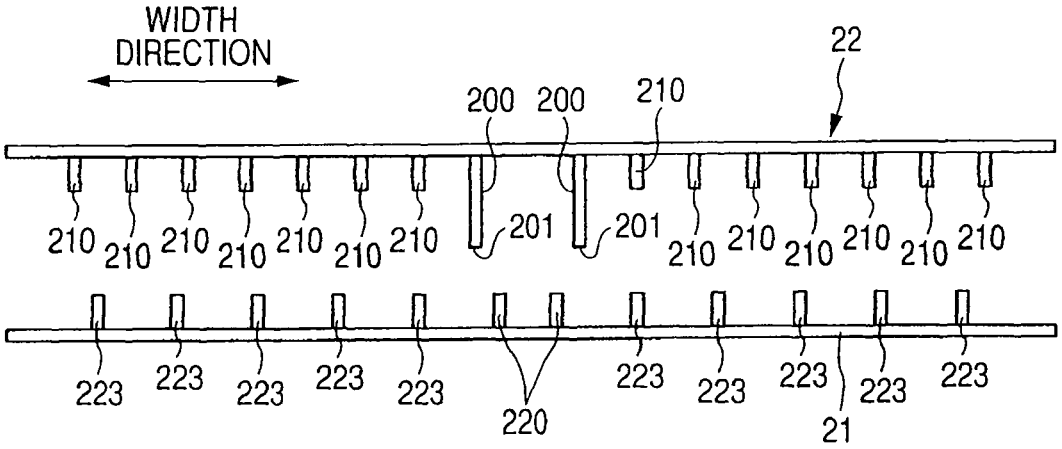
FIG. 8 is an exemplary sectional view along X-X of FIG. 6.

As shown in FIG. 6 through FIG. 8, a pair of the protrusion ribs 220 and a plurality of ribs 223 serve as an auxiliary guiding member. Both ribs 220, 223 are formed on the inner guide member 21 and protruded while facing the guide member 22.

The pair of the protrusion ribs 220 is sandwiched between the pair of protrusion ribs 200 along the width direction as shown in FIG. 8. The plurality of ribs 223 are fixed on both sides of the pair of protrusion ribs 200 in the width direction.

When the sheet 3 is guided by the guide surface 60 toward the protrusion ribs 200, the widthwise central portion of the surface of the sheet 3 opposite the surface facing the conveying surface 29A of the belt 29 comes into contact with the tip end portions 201 of the protrusion ribs 200 and the widthwise central portion of the tip end portion of the sheet 3 curves so as to protrude toward the conveying surface 29A of the belt 29. At this time, the ribs 220 and 223 come into contact with the surface facing the conveying surface 29A of the sheet 3 to stabilize the conveyance of the sheet 3.

Figure 9:
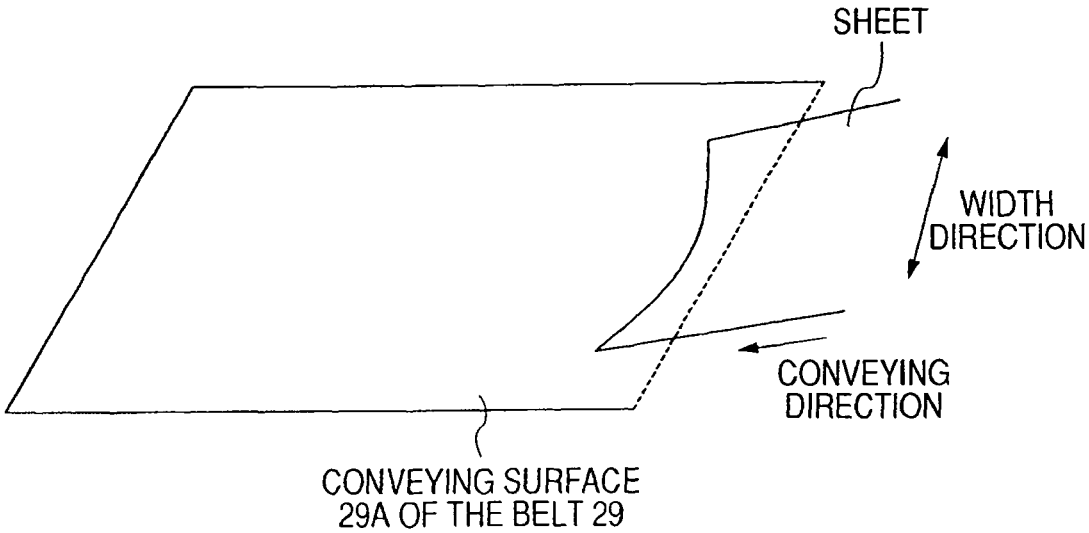
FIG. 9 is an exemplary schematic view showing the contact of the tip end portion of the sheet with the conveying surface of the belt.

The tip end portion of the sheet 3 guided by the protrusion ribs 200 moves toward the conveying surface 29A of the belt 29 while the widthwise central portion protrudes toward the conveying surface 29A of the belt 29 as show in FIG. 9.

When the sheet 3 is guided while curved by the protrusion ribs 200, the sheet 3 can be guided to the conveying surface 29A of the belt 29. First, the curved widthwise central portion of the sheet 3 protrudes toward the conveying surface 29A of the belt 29 and comes into contact with the conveying surface 29A of the belt 29. The contact area of the sheet 3 spreads to both ends of the width direction of the sheet 3 while being conveyed, and air between the conveying surface 29A of the belt and the sheet 3 is released to both end sides.

The protrusion ribs 200 that guide the tip end portion of the sheet 3 toward the conveying surface 29A of the belt 29 are in contact with the surface of the sheet 3 opposite the surface facing the conveying surface 29A of the belt 29, so that the tip end portion of the sheet 3 is restricted from being warped in a direction of separating from the conveying surface 29A, and comes into contact with the conveying surface 29A of the belt 29 more reliably than in the related-art. As a result, occurrence of void due to air trapped between the tip end portion of the sheet 3 and the conveying surface 29A of the belt 29 is prevented, and lowering in quality of an image formed on the sheet 3 can be prevented.

To curve the widthwise central portion of the tip end portion of the sheet 3, protrusion ribs 20 whose front end areas are small are used, so that in comparison with a case where ribs whose contact portions with the sheet spread in a sheet-like shape, the contact areas with the sheet 3 become smaller, and the conveyance resistance to the sheet 3 can be reduced. As a result, the sheet 3 can be prevented from jamming near the protrusion ribs 200.

The protruded front end portions 201 of the protrusion ribs 20 are inclined and protrusion amount of the protrusion ribs 20 gradually increases toward the downstream side from the upstream side. Accordingly, when the sheet 3 comes into contact with the protrusion ribs 200, the conveyance resistance to the sheet 3 can be prevented from suddenly increasing. Near the protrusion ribs 200, the sheet 3 can be prevented from jamming.

By electrostatically adsorbing the sheet 3 by the conveying surface 29A of the belt 29, the sheet 3 can be more reliably brought into close contact with the conveying surface 29A of the belt 29. However, at the same time, if air is trapped between the sheet 3 and the conveying surface 29A of the belt 29, the conveying surface 29A of the belt 29 and the sheet 3 are in close contact with each other around the air, so that the air is hardly released. However, according to the example structure of the invention, as described above, when the sheet 3 comes into contact with the conveying surface 29A of the belt 29, the air trapped between the sheet 3 and the conveying surface 29A of the belt 29 is released, so that air between the sheet 3 and the conveying surface 29A of the belt 29 is not be trapped.

The tip end portion of the sheet 3 is fed to the guide surface 60 recessed into a concave shape by the resist rollers 17A and 17B, so that the tip end portion of the sheet 3 becomes difficult to separate from the guide surface 60 during feeding to the downstream side of the guide surface 60, so that the tip end portion of the sheet 3 can be more reliably guided to the protrusion ribs 200.

In addition, a speed of which the sheet 3 is conveyed by the resist rollers 17A and 17B is higher than a speed of which the sheet is conveyed on the belt 29, so that the sheet 3 slackens between the belt 29 and the resist rollers 17A and 17B, and the surface of the sheet 3 opposite the surface facing the conveying surface 29A of the belt 29 more reliably comes into contact with the guide surface 60 recessed into a concave shape. As a result, the surface is more reliably guided to the protrusion ribs 200, whereby the widthwise central portion of the surface is more reliably protruded toward the conveying surface 29A of the belt 29, and air trapped between the surface and the conveying surface 29A of the belt 29 can be more reliably prevented.

When the sheet 3 is fed out by the resist rollers 17A and 17B, the tip end portion of the sheet 3 comes into contact with the vicinity of the upstream side end of the guide surface 60. Then, as the resist rollers 17A and 17B push the sheet 3, the sheet 3 moves to the downstream side while its tip end portion rubs against the guide surface 60, and accordingly, the tip end portion of the sheet 3 gradually changes its direction to the protrusion rib 200 side. Herein, in the example structure of the invention, the contact angle E of the tip end portion of the sheet 3 with the guide surface 60 is set to be equal to or less than 45 degrees. The contact angle E of the tip end portion of the sheet 3 can be obtained from "E=90°−C" provided that an angle between the tip end portion of the sheet 3 and the normal of the guide surface 60 at the contact point is defined as C. When the tip end portion of the sheet 3 comes into contact with the guide surface 60 at a great angle, the load on the sheet 3 increases and the tip end portion of the sheet 3 may be damaged, however, according to this construction, the sheet 3 comes into contact with the guide surface 60 always at a gentle angle, so that the load on the sheet 3 can be suppressed.

When the sheet 3 thus moves to the downstream side while its front end rubs against the guide surface 60, an intermediate portion in the sheet 3 between its tip end portion and the nipping position 17C between the resist rollers 17A and 17B is curved so as to gradually become convex upward. Then, between the intermediate portion of the sheet 3 and the guide surface 60, a space S is formed due to the elasticity of the sheet 3 (see the chain line in FIG. 6).

Then, when the tip end portion of the sheet 3 passes over the downstream side end of the protrusion ribs 200 and comes into contact with the conveying surface 29A of the belt 29, the sheet 3 is electrostatically adsorbed by the conveying surface 29A of the belt 29 and conveyed rearward according to the movement of the belt 29. Herein, the sheet 3 fed out from the protrusion ribs 200 comes into contact with the conveying surface 29A of the belt 29 from the diagonally upper side. That is, an angle F between the feed-out direction of the sheet 3 from the protrusion ribs 200 and the conveying surface 29A of the belt 29 becomes $0<F<30$ degrees. Therefore, the force for pushing-out the sheet 3 from the resist rollers 17A and 17B act so as to press the sheet 3 against the conveying surface 29A of the belt 29, and the sheet 3 reliably comes into close contact with the conveying surface 29A of the belt 29 without floating therefrom.

The tip end portion of the sheet 3 thus adsorbed by the surface of the belt 29 is sandwiched between the photosensitive drum 42 on the immediately downstream side and the transfer roller 31 for the first color, and the first color is transferred here. Then, as the sheet 3 advances to the downstream side according to the movement of the belt 29, other colors are successively transferred by the respective photosensitive drums 42 and transfer rollers 31. Herein, the conveying speed Vr of the sheet 3 by the resist rollers 17A and 17B is higher than the conveying speed Vb of the sheet 3 on the belt 29, so that between the resist rollers 17A and 17B and the belt 29, the sheet 3 gradually slackens, and this slack is released to the space S formed between the sheet 3 and the guide surface 60. At this time, the sheet 3 is in a posture curved by the guide member 22 and the inner guide member 21, so that in comparison with slackening from a planar posture, loads on the sheet 3 and the resist rollers 17A and 17B, etc., are smaller, so that the sheet can be easily slackened.

When the rear end of the sheet 3 passes through the nipping position 17C of the resist rollers 17A and 17B, the rear end of the sheet 3 may vibrate in the thickness direction. However, in the present construction, such vibrations are suppressed by bringing the sheet 3 into contact with the guide member 22 or the inner guide member 21 disposed on both front and back surfaces. Therefore, it can be prevented that the vibration on the rear end of the sheet 3 is transmitted to the transfer position and causes color displacement.

Figure 5:
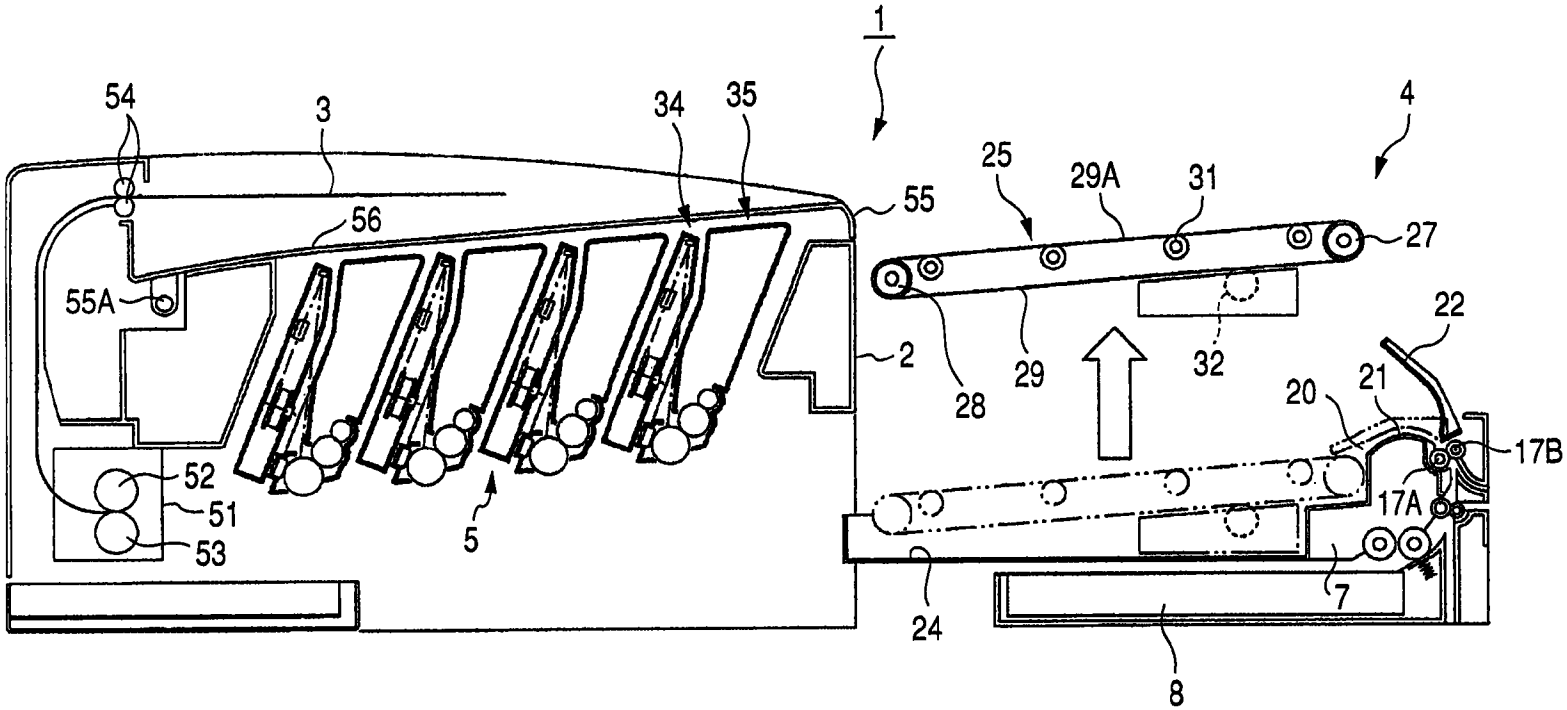
FIG. 5 is an exemplary sectional side view showing a state that the belt unit is detached from the conveying unit.

FIG. 5 is a sectional side view showing a state that the belt unit is detached from the conveying unit.

To perform jamming handling or replacement, etc., of the belt 29 in this laser printer 1, first, as shown in FIG. 3, the conveying unit 4 is drawn forward of the main body casing 2. Thereby, when the sheet 3 jams on the belt 29 or around the fixing device 51, this jamming can be solved. When the sheet 3 jams in the paper feed path 20 or near the resist rollers 17A and 17B, as shown in FIG. 5, the rear end of the guide member 22 is lifted and the guide member 22 is rotated to open the paper feed path 20, whereby jamming handling can be easily performed. To replace the belt unit 25, as described above, after opening the guide member 22, the belt unit 25 is detached upward from the belt unit attaching part 24 and replaced. When the sheet 3 jams near the paper feed roller 10 or near the paper dust removing rollers 13A and 13B, as shown in FIG. 2, by drawing the discharge tray 8 out of the unit frame 7, said jamming can be solved.

As described above, according to the example structure of the invention, the guide member 22 has the guide surface 60 which the tip end portion of the sheet 3 slidably comes into contact with. The guide surface 60 of the guide member 22 is curved into a concave shape so that the sheet 3 gradually changes its direction as it forwards to the downstream side of the conveying direction. By thus configuration, the sheet 3 fed out from the resist rollers 17A and 17B turns into a posture that the portion from the tip end portion to the nipping position between the resist rollers 17A and 17B gradually curves as it forwards to the downstream side while the tip end portion is in rubbing contact with the guide surface 60 of the guide member 22, and a space is formed between the same and the guide surface 60 due to the elasticity of the sheet 3. Thereby, the sheet 3 can be smoothly curved. When the conveying speed Vr of the sheet 3 by the resist rollers 17A and 17B is higher than the conveying speed Vb on the belt 29, the slack of the sheet 3 is released to the space between the sheet and the guide surface 60, so that the sheet 3 can be easily slackened. Therefore, without a great load on the sheet 3 itself, the sheet 3 can be stably conveyed.

The sheet 3 fed out from the guide member 22 comes into contact with the conveying surface 29A of the belt 29 from the diagonally upper side. When the sheet 3 fed out from the guide member 22 comes into parallel contact with the conveying surface 29A of the belt 29, the sheet 3 may float from the conveying surface 29A of the belt 29, however, according to this construction, the sheet 3 is pressed against the conveying surface 29A of the belt 29, so that the sheet 3 can be reliably brought into close contact with the conveying surface 29A of the belt 29.

With respect to the conveying speed Vb of the sheet 3 on the belt 29, the conveying speed Vr of the sheet 3 by the resist rollers 17A and 17B is set to Vr>Vb. Thereby, it can be prevented that drawing of the sheet 3 between the belt 29 and the resist rollers 17A and 17B makes the conveyance of the sheet 3 unstable and harmfully influences the quality of an image to be recorded.

The conveying rollers for feeding-out the sheet 3 to the belt 29 side are resist rollers 17A and 17B that correct the tip end portion of the sheet 3, so that other resist rollers are not necessary, and the construction becomes simple.

The contact angle of the tip end portion of the sheet 3 with the guide surface 60 of the guide member 22 is set to be always not more than 45 degrees. When the tip end portion of the sheet 3 is pressed against the guide surface 60 at a great contact angle, the load on the sheet 3 increases and the tip end portion of the sheet 3 may be damaged, however, according to the present construction, the tip end portion of the sheet 3 comes into contact with the guide surface 60 always at a gentle angle, so that the sheet 3 can be prevented from being damaged.

An inner guide member 21 for forming a conveying path for the sheet 3 between the same and the guide member 22 is provided, and on this inner guide member 21, a convex guide surface 63 curved into a convex shape so as to face the guide surface 60 is formed, so that the sheet 3 can be smoothly guided. For example, even when the rear end of the sheet 3 vibrates in the thickness direction, this vibration can be reduced.

The guide member 22 is made movable to open the paper feed path 20 as a conveying path for the sheet 3, so that jamming of the sheet 3 on the inner side of the guide member 22 can be easily handled.

The feed-out direction D1 of the sheet 3 from the resist rollers 17A and 17B is inclined toward the conveying direction of the sheet 3 on the belt 29 more than the direction orthogonal to the conveying surface 29A of the belt 29 for the sheet 3 on the belt 29. Thereby, even when the apparatus is downsized, curvature of the sheet 3 in the paper feed path 20 can be made small.

By forming a reinforcement edge 62 extending to the side of a surface opposite the guide surface 60 on the downstream side end of the guide member 22, the strength of the end of the guide member 22 can be improved.

According to the example structure of the laser printer 1, the conveyance accuracy of the sheet 3 is secured by the conveying unit 4 including the guide member 22 having the guide surface 60, so that high-quality image forming is realized.

In addition, the transfer roller 31 is disposed continuously from the downstream side of the belt support roller 27 disposed closest to the guide member 22, and the guide member 22 brings the tip end portion of the sheet 3 into contact between the support position of the belt support roller 27 and the contact position of the transfer roller 31 on the belt 29. Thereby, it becomes unnecessary to provide a roller or the like for pressing the sheet 3 against the belt 29 between the belt support roller 27 and the transfer roller 31. Therefore, the number of components can be reduced and downsizing of the apparatus is realized.

In addition, the guide member 22 is disposed so that a part of this enters between the process cartridge 35 and the belt 29, whereby the apparatus can be downsized. The conveying unit 4 including the resist rollers 17A, 17B, the guide member 22, and the belt 29 is formed so that it can be drawn out of the main body casing 2, so that maintenance such as jamming handling and parts replacement can be easily performed.

By forming the conveying path for the sheet 3 into a so-called S shape, the apparatus according the example structure can be made compact.

By applying the example structure of the present invention to a direct tandem color laser printer including developing cartridges 44 and photosensitive drums 42 for the respective colors, the conveyance accuracy of the sheet 3 is secured, so that high-quality color image forming is realized.

<Another Example Structure>

Another example structure will be described with reference to FIG. 1 and FIG. 11. Description of the construction substantially the same as that of the example structure will be omitted.

Figure 10:
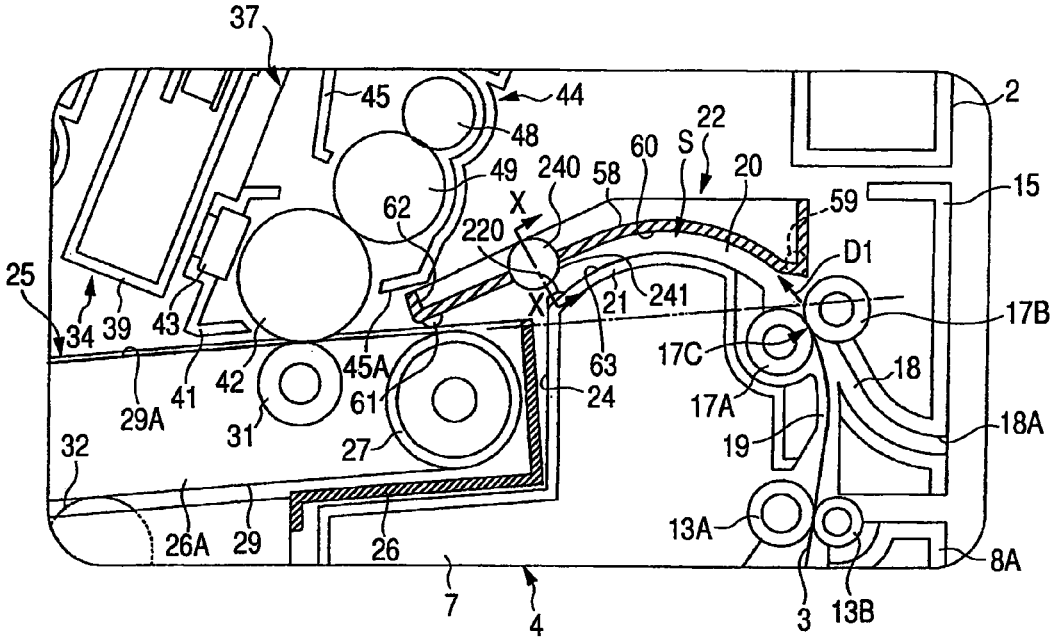
FIG. 10 is an exemplary enlarged sectional side view of the vicinity of the guide member.
Figure 11:
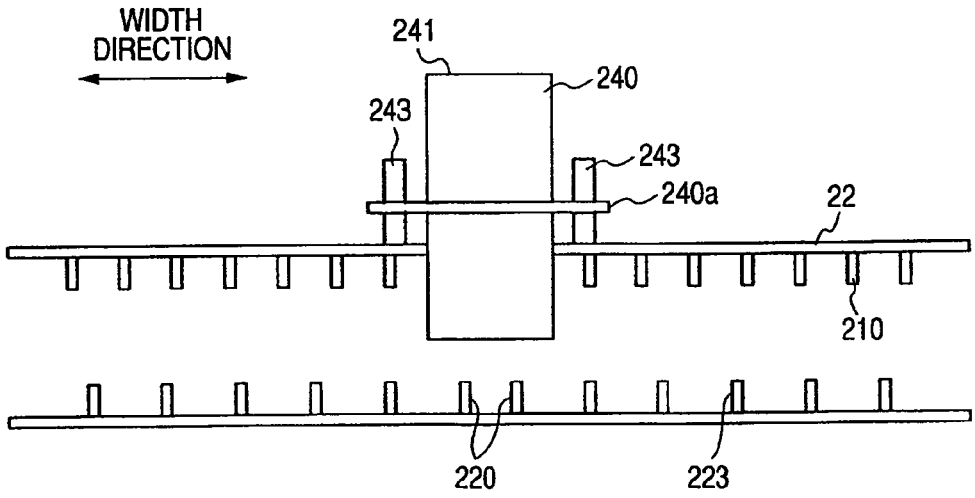
FIG. 11 is an exemplary sectional view along X-X of FIG. 10.

FIG. 10 is an enlarged sectional side view of the vicinity of the guide member, and FIG. 11 is a sectional view along X-X of FIG. 10.

In the example structure, to protrude the width direction of the sheet 3 toward the conveying surface 29A of the belt 29, the protrusion ribs 200 are used, however, another example structure is different from the example structure in that a roller 240 serving as a guiding member and the rotary body is used instead.

Therefore, description of the same points as in the example structure will be omitted.

On the guide member 22, as shown in FIG. 10 and FIG. 11, a roller 240 as an example of the guiding member, disposed adjacent to the conveying direction downstream side of the guide surface 60 so as to face the conveying surface 29A of the belt 29, is rotatably supported.

The roller 240 is supported on a bearing 243 of the guide member 22 rotatably via a rotation shaft 240*a* so that the peripheral surface 241 thereof protrudes more than the ribs 210 at the width direction central portion of the guide member 22 as shown in FIG. 11.

With this construction, when the sheet 3 is guided by the guide surface 60 toward the roller 240, the width direction central portion of the surface of the sheet 3 opposite the surface facing the conveying surface 29A of the belt 29 comes into contact with the peripheral surface 241 of the roller 240 and the width direction central portion of the tip end portion of the sheet 3 curves so as to protrude toward the conveying surface 29A of the belt 29. When the sheet 3 is thus guided while being curved by the peripheral surface 241 of the roller 240, the sheet 3 can be guided to the conveying surface 29A of the belt 29 in a manner in that, first, the width direction central portion which was curved and protruded toward the conveying surface 29A side of the sheet 3 comes into contact with the conveying surface 29A of the belt 29, and while conveyed, this contact area gradually spreads to both ends in the width direction of the sheet 3 and air between the conveying surface 29A of the belt 29 and the sheet 3 is released to both end sides.

When the sheet 3 comes into contact with the roller 240, the roller rotates to release the force of this contact, so that the conveyance resistance to the sheet 3 can be suppressed. As a result, the sheet 3 can be prevented from jamming near the roller 240.

<Still Another Example Structure>

Figure 12:
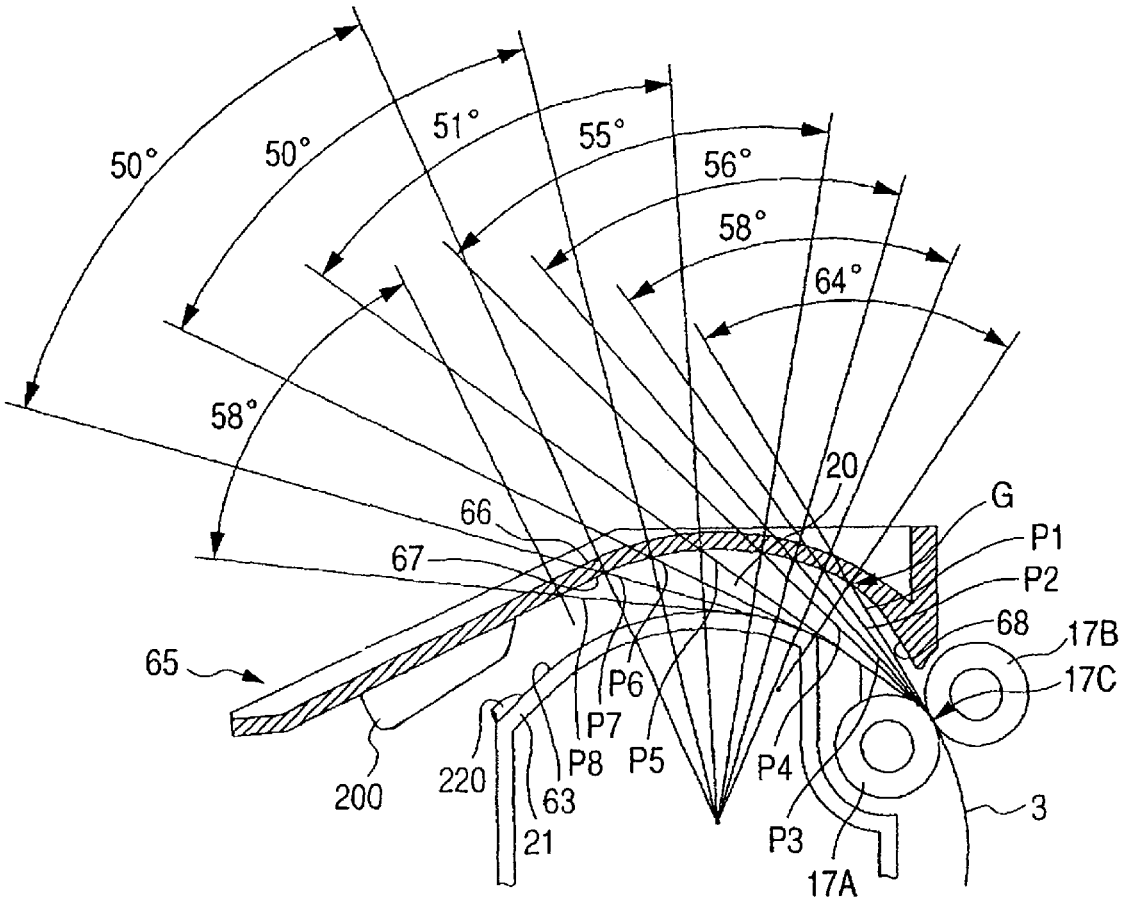
FIG. 12 is an exemplary enlarged sectional side view of the vicinity of the guide member.

Next, another example structure will be described with reference to FIG. 12. The construction according to still another example structure is substantially the same as that of the example structure except for the shape of the guide member 65. Description of the construction substantially the same as that of the example structure will be omitted.

The guide member 65 *o* has a plate-shaped part 66 formed along the paper feed path 20, and on the lower surface of this plate-shaped part 66, a guide surface 67 which the tip end portion of the sheet 3 fed out from the resist rollers 17A and 17B can come into rubbing contact with is formed. The guide surface 67 is curved into a concave shape so that it gradually changes in direction from the upper stream side toward the downstream side as in the example structure, and the guide surface gradually separates from the conveying surface 29A of the belt 29 and then gradually approaches the conveying surface 29A of the belt 29 in a direction orthogonal to the conveying surface 29A of the belt 29. In FIG. 12, the point G on the plate-shaped part 66 indicates a position at which the tip end portion of the sheet 3 fed out from the resist rollers 17A and 17B comes into contact with the plate-shaped part 66 for the first time, and corresponds to the upstream side end of the guide surface 67. On the plate-shaped part 66, an extended guide surface 68 extended to the upstream side from the upstream side end of the guide surface 67 is formed, and this extended guide surface 68 is formed to extend to the vicinity of the nipping position between the resist rollers 17A and 17B. The extended guide surface 68 is formed so as to be inclined to the diagonally lower rear side smoothly continuously to the guide surface 67, and can be rubbing-contacted by a part of the sheet 3 (a part other than the tip end portion).

Furthermore, adjacent to the downstream side end of the guide surface 27, protrusion ribs 200 similar to those of the example structure are provided, and ribs 220 are provided so as to face the guide member 25.

On the guide member 65, the extended guide surface 68 extended to the upstream side more than the guide surface 67 that the tip end portion of the sheet 3 comes into contact with is formed up to the vicinity of the resist rollers 17A and 17B, so that, for example, the rear end of the sheet 3 can be prevented from springing up and vibrating when it passes through the resist rollers 17A and 17B. Therefore, the sheet 3 can be stably conveyed, and the quality of an image to be recorded can be secured.

In the same drawing, the position of the sheet 3 when the tip end portion of the sheet 3 comes into contact with the point G is shown by the line P1, and examples of the angles between the sheet 3 at the contact point at which the tip end portion of the sheet 3 is in contact with the guide surface 67 and the normal of the guide surface 67 when the sheet 3 moves toward the downstream side to the positions of P2, P3 . . . P8 in order are shown. As described above, the contact angle E of the tip end portion of the sheet 3 with the guide surface 67 can be calculated from "E=90°−C" provided that the angle between the tip end portion of the sheet 3 and the normal of the guide surface 67 at the contact point. Thereby, when the sheet 3 is at the position of P1, E=90°−64°=26°, and as the sheet 3 moves to P2, P3 . . . , the value of E gently changes to 32°, 34°, 35°, 39°, 40°, 40°, and 32° in order. The positions of P1 through P8 indicate positions on the assumption that the sheet 3 has sufficiently high rigidity, and in actuality, according to the level of elasticity of the sheet 3, the sheet 3 curves outward, so that the value of the contact angle E becomes smaller than the above-described values.

As described above, the contact angle E of the tip end portion of the sheet 3 with the guide surface 67 is set to be always not more than 45 degrees (40 degrees or less). Thereby, the sheet 3 comes into contact with the guide surface 67 always at a gentle angle, so that the load on the sheet 3 can be suppressed. The sheet 3 is most difficult to be curved when its tip end portion comes into contact with the guide member 65 for the first time, however, as described above, the contact angle E of the tip end portion of the sheet 3 is set to be a small value near the point G on the guide surface 67, so that curving can be started without great loads on the sheet 3 and the resist rollers 17A and 17B.

<Still Yet Another Example Structure>

Figure 13:
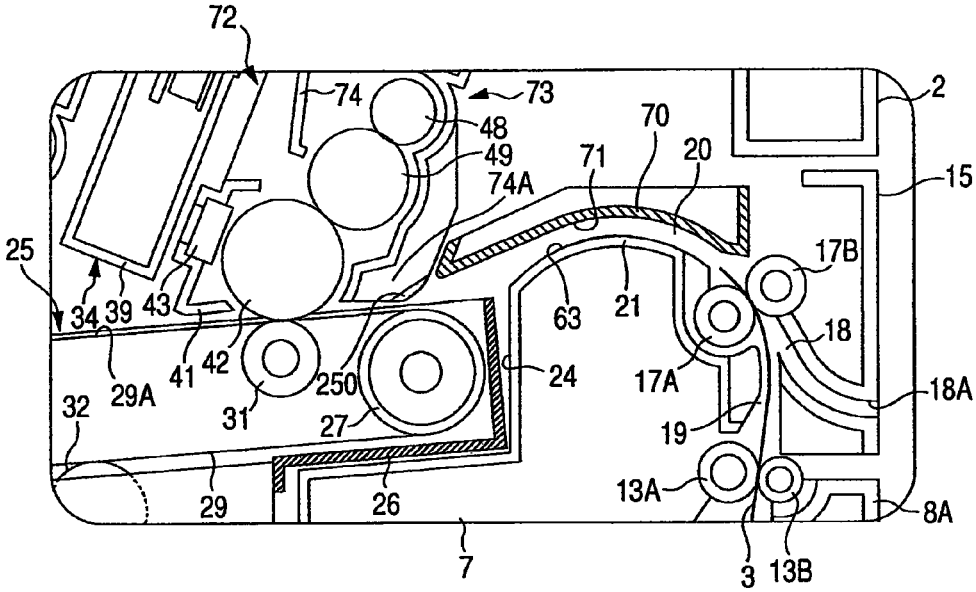
FIG. 13 is an exemplary enlarged sectional side view of the vicinity of the guide member.

Next, still yet another example structure will be described with reference to FIG. 13. In the following description, description of the construction substantially the same as in the example structure will be omitted.

On the downstream side of a guide member 70 provided in an image forming apparatus main body having a guide surface 71, a protrusion rib 250 as an example of the guiding member is provided so as to face the conveying surface 29A of the belt 29 on the lower end of a case 74 of a developing cartridge 73 provided detachably from the process cartridge 72. That is, the protrusion rib 250 protrudes in the width direction central portion of the tip end portion of a sheet 3 fed from the guide 70 toward the conveying surface 29A of the belt 29, and feeds the tip end portion of the sheet 3 to the conveying surface 29A of the belt 29.

With this construction, when the sheet 3 is guided by the guide surface 71 to the protrusion rib 250, the width direction central portion (in the recording sheet conveying direction) of the surface of the sheet 3 opposite the surface facing the conveying surface 29A of the belt 29 comes into contact with the protrusion rib, and the width direction central portion of the tip end portion of the sheet 3 curves so as to protrude toward the conveying surface 29A of the belt 29. When the sheet 3 is thus guided while curved by the protrusion rib 250, the sheet 3 can be guided to the conveying surface 29A of the belt 29 in a manner in that, first, the width direction central portion of the sheet 3 curved and protruded toward the conveying surface side comes into contact with the conveying surface 29A of the belt 29, the contact area gradually spreads to both end sides of the width direction of the sheet 3 while conveyed, and air between the conveying surface 29A of the belt 29 and the sheet 3 is released to both end sides.

The protrusion rib 250 is fixed to the developing cartridge 73 which is detachably attached to the image forming apparatus main body, and on the other hand, the guide member 70 is provided in the image forming apparatus main body separately from the protrusion rib 250, so that when the sheet 3 jams between the protrusion rib 250 and the guide member 70, the sheet 3 can be easily removed by detaching the developing cartridge 73 from the image forming apparatus main body.

<Further Still Yet Another Example Structure>

Figure 14:
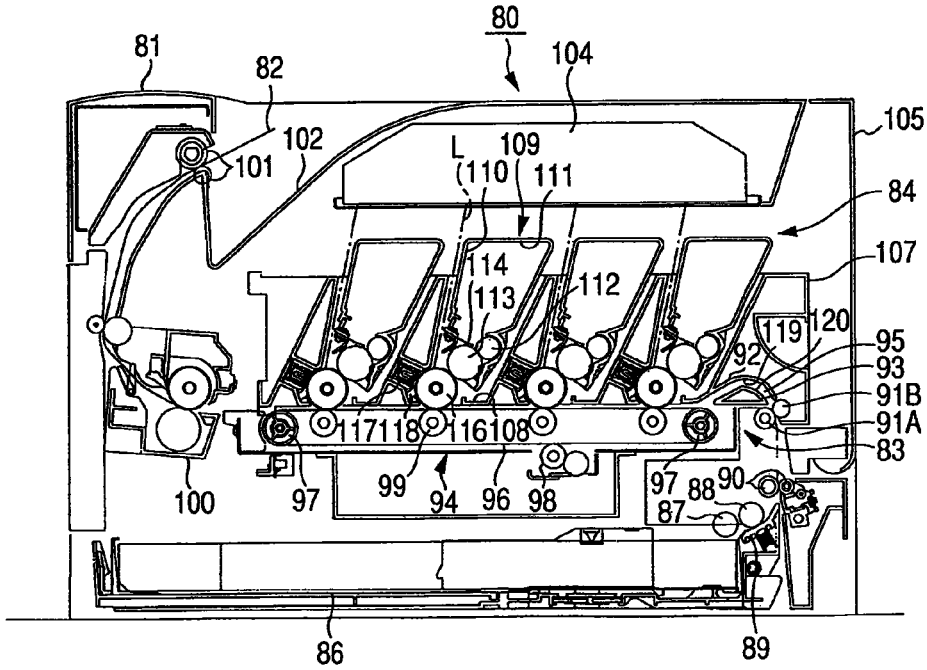
FIG. 14 is an exemplary sectional side view showing a general construction of a laser printer according to another example structure of the image forming apparatus.
Figure 15:
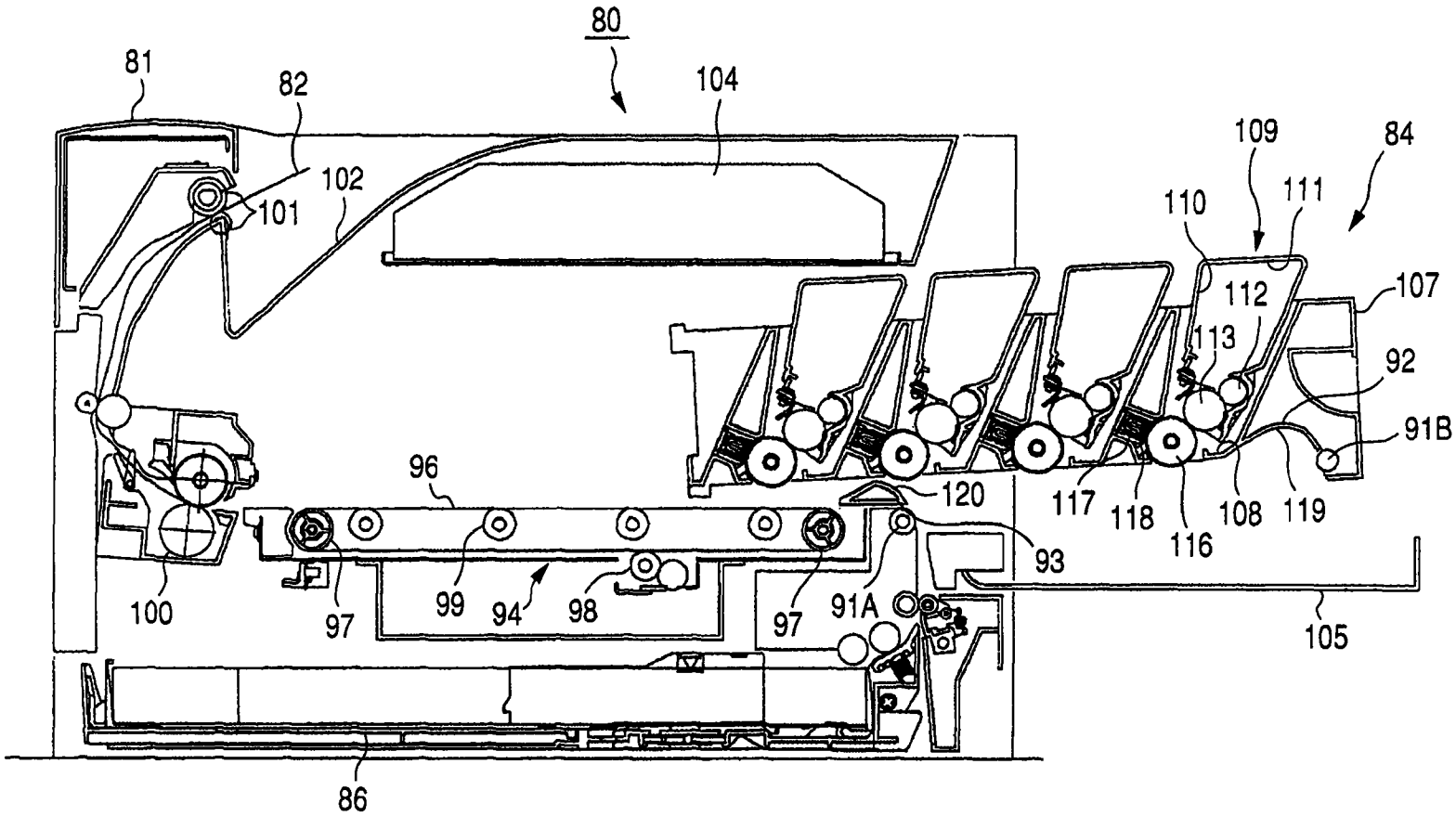
FIG. 15 is an exemplary sectional side view showing a general construction of a laser printer according to another example structure of the image forming apparatus.
Figure 16:
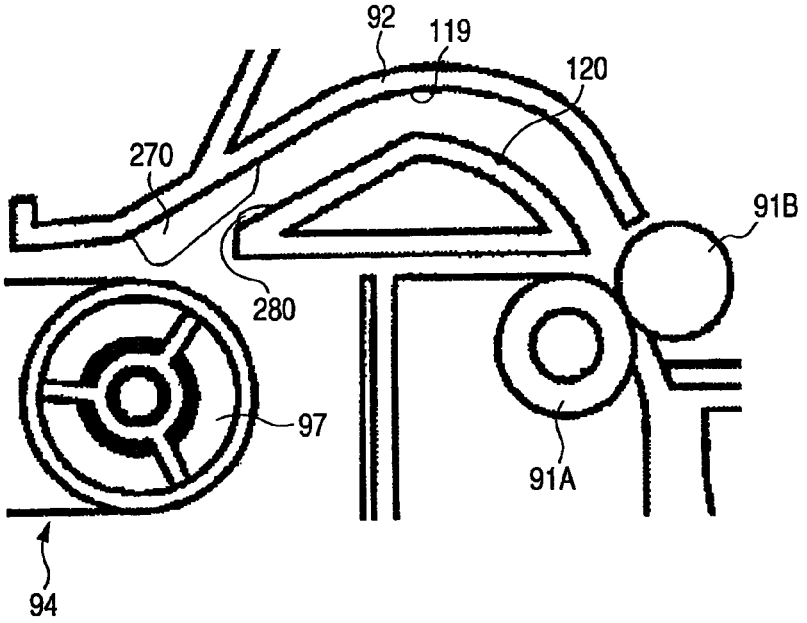
FIG. 16 is an exemplary enlarged sectional side view of the vicinity of the guide member.

Next, further still yet another example structure will be described with reference to FIG. 14 through FIG. 16. In FIG. 14 and FIG. 15, a protrusion rib 270 serving as the guiding member and a rib 280 serving as the auxiliary guiding member are not shown. In the following description, description of the construction substantially the same as in the example structure will be omitted.

The laser printer 80 is a direct tandem color laser printer including four photosensitive drums 116 corresponding to the colors of black, cyan, magenta, and yellow, respectively. The laser printer 80 includes, in a main body casing 81, a sheet conveying device 83 for conveying a sheet 82 as a recording sheet and an image forming unit 84 for forming an image on the sheet 82 conveyed by the sheet conveying device 83. In the following description, the right side of FIG. 15 is defined as the front side.

On the lower side of the main body casing 81, a paper feeding tray 86 which can be drawn out forward is provided, and sheets 82 stacked therein are supplied to resist rollers 91A and 91B of the sheet conveying device 83 by a pickup roller 87, a paper feed roller 88, a separating pad 89, and a pair of paper dust removing rollers 90.

The sheet conveying device 83 includes the pair of resist rollers 91A and 91B, a guide member 92, and a belt unit 94. A sheet 82 fed out from the resist rollers 91A and 91B passes through a paper feed path 95 formed between the guide member 92 and an inner guide member 93 and is conveyed onto a belt 96 of a belt unit 94. The belt unit 94 includes a pair of front and rear belt support rollers 97, the inner guide member 93, the belt 96, a cleaning roller 98, and transfer rollers 99, etc., and the entirety is detachable from the main body casing 81. While the sheet 82 is conveyed rearward on the belt 96, transfer of images in the respective colors is performed by the photosensitive drums 116 of the image forming unit 84 and the transfer rollers 99 of the belt unit 94. Then, the sheet 82 passes through a fixing device 100 disposed rear of the belt unit 94 and is ejected onto the discharge tray 102 on the upper surface of the main body casing 81 by an eject roller 101.

On the upper side of the main body casing 81, a scanner 104 as an example of the exposing unit which emits a laser beam L onto the respective photosensitive drums 116 is provided, and between the scanner 104 and the belt 96, an image forming unit 84 is housed. On the front face of the main body casing 81, a front cover 105 that can open and close is provided, and by opening this front cover 105, the image forming unit 84 becomes able to be drawn out forward of the main body casing 81. The image forming unit 84 includes a substantially box-shaped frame 107. On the frame 107, four cartridge attaching parts 108 opened upward are provided in line in the front and rear direction, and to the respective cartridge attaching parts 108, four developing cartridges 109 corresponding to the respective colors are detachably attached. Each developing cartridge 109 includes a toner containing chamber 111, a supply roller 112, a developing roller 113, and a layer thickness restricting blade 114 in the case 110. On the frame 107, on the lower side of each cartridge attaching part 108, a photosensitive drum 116 disposed so as to face the developing roller 113 and the transfer rollers 99 is held, and furthermore, around the photosensitive drum, a scorotron charger 117 and a cleaning brush 118 are held. On the bottom surface of the front side of the frame 107, the above-described guide member 92 having a guide surface 119 curved into a concave shape is formed integrally. One resist roller 91B is held on the front end side (upstream side) of the guide member 92. On the main body casing 81 side, an inner guide member 93 including a convex guide surface 120 facing the guide surface 119 and the other resist roller 91A are provided.

At the width direction central portion of the guide member 92, a protrusion rib 270 as an example of the guiding member is projectedly fixed so as to come into contact with the width direction central portion of the sheet 3.

To the inner guide member 120, a rib 280 as an example of the auxiliary guiding member that faces the guide member 92 and protrudes is fixed.

When the sheet 82 is guided by the guide surface 119 toward the protrusion rib 270, the width direction central portion (in the recording sheet conveying direction) of the surface of the sheet 82 opposite the surface facing the conveying surface of the belt 96 comes into contact with the protrusion rib, and the width direction central portion of the tip end portion of the sheet 82 curves so as to protrude toward the conveying surface of the belt 96. When the sheet 82 is guided while thus curved by the protrusion rib 270, the sheet 82 can be guided to the conveying surface in a manner that, first, the width direction central portion curved and protruded toward the conveying surface side of the belt 96 of the sheet 82 comes into contact with the conveying surface, and the contact area gradually spreads to both end sides in the width direction of the sheet 82 while conveyed, and air between the conveying surface and the sheet 82 is released to both end sides.

The rib 280 (inner guide) is provided integrally with the belt 96 by a joint mechanism that is not shown, so that its positional accuracy with respect to the belt 96 increases, and the sheet 82 is more reliably guided to the conveying surface of the belt 96.

By detaching the belt 96 from the image forming apparatus main body, a sheet 82 jamming at the rib 280 can be more easily removed.

The photosensitive drum 116 and the protrusion rib 270 are integrally provided via the frame 107, so that the positional accuracy of the protrusion rib 270 with respect to the photosensitive drum 116 is improved, and the sheet 82 can be accurately guided to the belt 96 facing the photosensitive drum 116.

By detaching the frame 107 from the image forming apparatus main body, the sheet 82 jamming at the protrusion rib 270 can be easily removed.

In the laser printer 80, by drawing the image forming unit 84 out of the main body casing 81, each developing cartridge 109 can be exchanged. By detaching the drawn-out image forming unit 84 from the main body casing 81, the upper surface of the belt 96 and the paper feed path 95 are opened, so that jamming handling or parts replacement of the belt 96, etc., can be easily performed.

<Another Example Structure>

Figure 17:
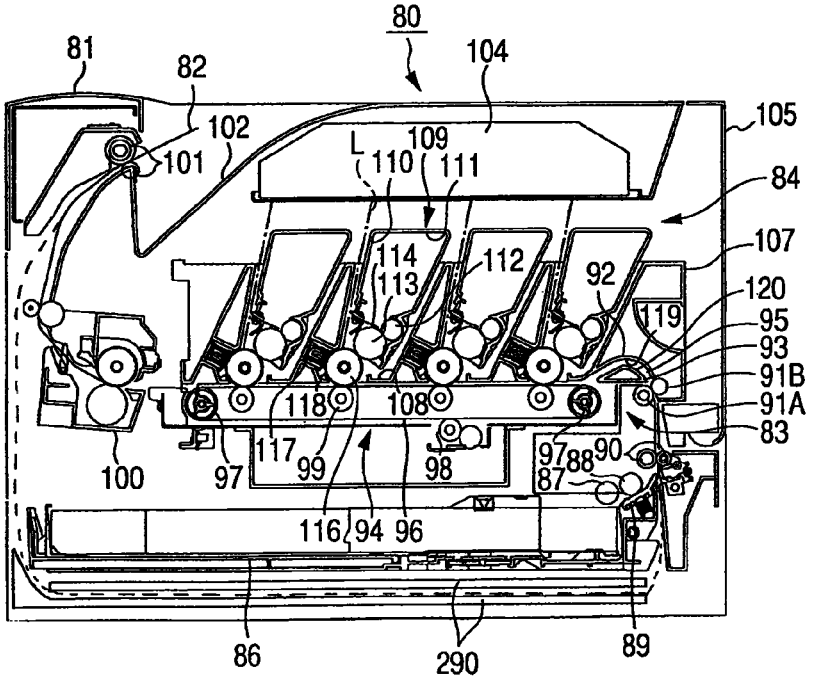
FIG. 17 is an exemplary sectional side view of a general construction of a laser printer according to an example structure of the image forming apparatus.

Next, another example structure will be described with reference to FIG. 17. In the following description, description of the construction substantially the same as further still yet another example structure will be omitted.

In the laser printer 80, a sheet 82 having a surface on which an image was formed is fed to an eject roller 101, and is fed into a re-conveying mechanism 290 by reverse-rotation of the eject roller 101. The sheet 82 fed into the re-conveying mechanism 290 is conveyed again to the resist rollers 91A and 91B in a reversed state (the dashed line in FIG. 17 indicates a conveying path of the sheet since the time when the eject roller 101 rotates in reverse).

With this construction, a surface of the sheet 82 conveyed by the re-conveying mechanism 290, opposite the printed surface, comes into contact with the protrusion rib 270, so that stain of the printed surface and scattering of the toner from this surface can be prevented.

<Still Another Example Structure>

Next, still another example structure will be described with reference to FIG. 18 through FIG. 22. In the following description, description of the construction substantially the same as in further still yet another example structure will be omitted.

Figure 18:
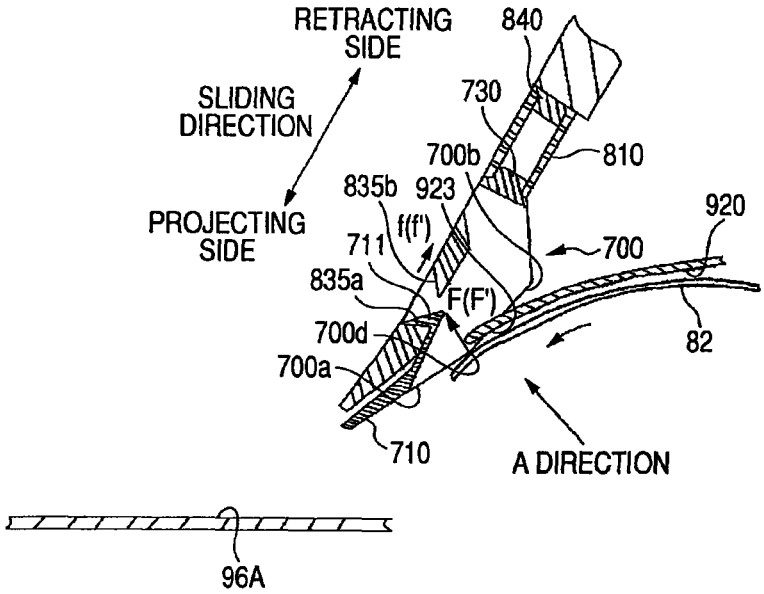
FIG. 18 is an exemplary sectional side view showing a state that the guiding member 700 is at the position projecting toward the surface of the sheet 82.

A guiding member 700 is different from the protrusion rib 270 in that it is supported so as to be slidable between a position projecting toward the surface of the guided sheet 82 and a position retracted from the surface of the sheet 82. A guide surface 920 shown in FIG. 18 is fixed to a frame 107.

To the frame 107, a support member 800 which supports the guiding member 700 in a manner enabling it to slide between the position projecting toward the sheet 82 guided from the guide surface 920 and the position retracted from the sheet 82 is fixed. Herein, the "retracted position" is positioned at a diagonally upper side from the front side with respect to the "projecting position." Hereinafter, the sliding movement direction of the guiding member 700 is referred to as "sliding direction," and the side of the "projecting position" in the sliding direction is referred to as "projection side" and the side of the "retracted position" is referred to as "retracting side."

[Guiding Member 700]

Figure 20:
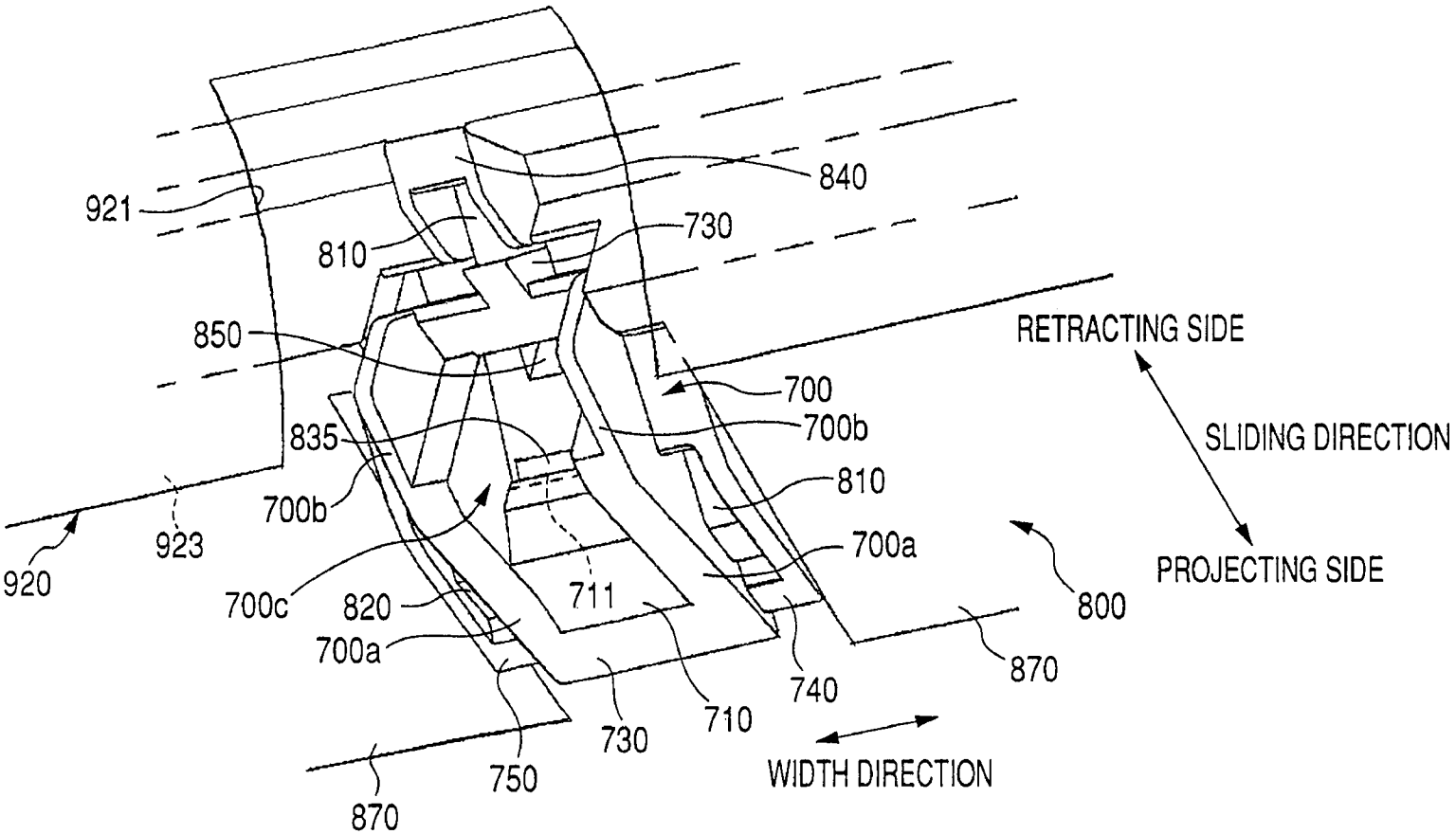
FIG. 20 is an exemplary perspective view of the guiding member 700 from the lower side.
Figure 21:
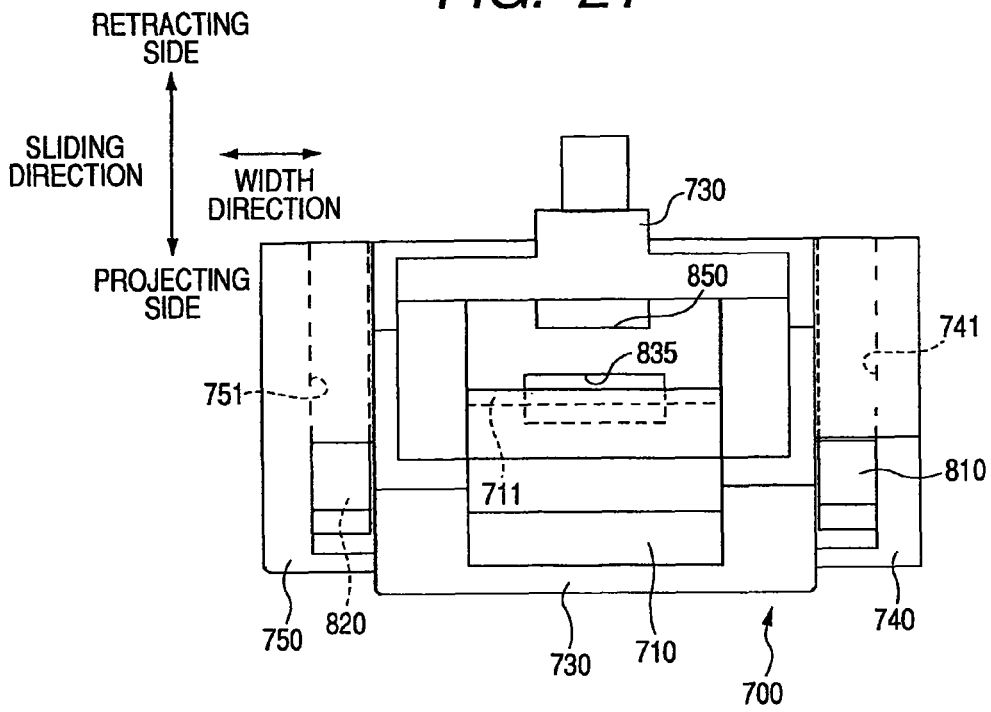
FIG. 21 is an exemplary view of the guiding member 700 on the arrow A of FIG. 18.

The guiding member 700 integrally has, as shown in FIG. 20 and FIG. 21, a first side portion 740 and a second side portion 750 disposed on both sides in the width direction, respectively, and a central portion 730 disposed at a width direction center.

Figure 19:
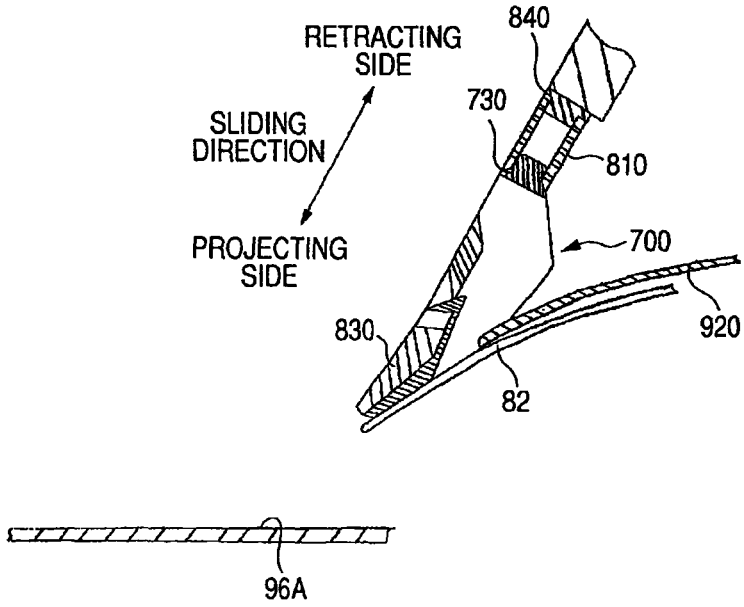
FIG. 19 is an exemplary sectional side view showing a state that the guiding member 700 is at the position retracted from the surface of the sheet 82 more than a projecting position of the guiding member.

The central portion 730 is a member with substantially a trapezoid shape in a side view, integrally having a sliding portion 710 disposed on the lower side (projection side) and a receiving portion 730 disposed on the upper side (retracting side) as shown in FIG. 18 and FIG. 19. Between the sliding portion 710 and the receiving portion 730 of the central portion 730, an exposure hole 700*c* for exposing the support member 800 is formed.

The sliding portion 710 integrally has a claw 711, and this claw is fitted in a sliding hole 835 (see FIG. 22) formed in a support member 800 described later so as to be slidable in the sliding direction.

The receiving portion 730 fits a compression coil spring 810 (see FIG. 22) serving as an urging unit and is urged to the projection side toward the sheet 82 in the sliding direction. Herein, as described later, when the sheet 82 guided from the guide surface 920 comes into contact with the guiding member 700, the guiding member 700 is pushed to the retracting side by the elasticity (elastic force) of the sheet 82.

On a lower side of the central portion 730 on a side facing the conveying surface of the belt 96A 96, a first surface 700*a* for protruding the width direction central portion of the sheet 82 toward the conveying surface of the belt is formed, and continuously from the upper end of the lower side, a second surface 700*b* is formed.

The first surface 700*a* is a plane inclined so as to extend upward toward the front side with respect to the conveying surface of the belt extending substantially horizontally as shown in FIG. 18 and FIG. 19.

The second surface 700*b* extends while inclined upward toward the front side, and the upward inclination is formed so as to form a plane steeper than the first surface.

In the first side portion 740, a cylindrical sliding hole 741 extending in the sliding direction is formed. This cylindrical sliding hole 41 is supported so as to be slidable with a first restricting member 810 (see FIG. 22) of a support member 800 described later in the sliding direction.

In the second side portion 750, a cylindrical sliding hole 751 is formed similarly to the first side portion 740, and this cylindrical sliding hole 752 is supported so as to be slidable with a second restricting member 820 of the support member 800 described later in the sliding direction.

[Support Member 800]

Figure 22:
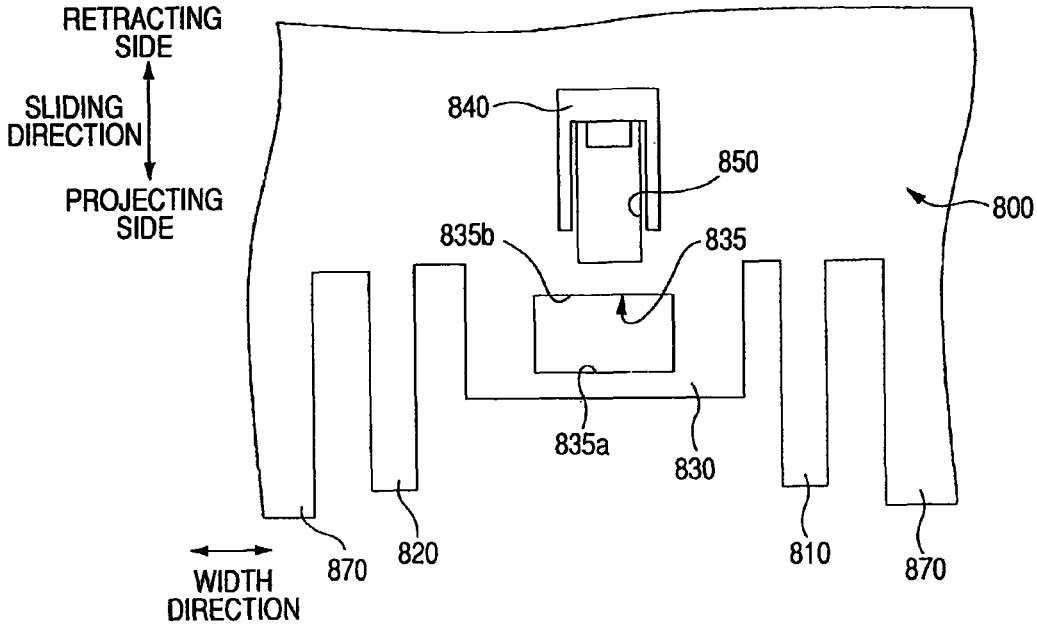
FIG. 22 is an exemplary view of the support member 800 on the arrow A of FIG. 20.

The support member 800 integrally includes, as shown in FIG. 20 and FIG. 22, auxiliary guiding surfaces 870 disposed on both sides in the width direction, the first restricting member 810 and the second restricting member 820 disposed more inward in the width direction than the auxiliary guiding surfaces 870, and a third restricting member 830 disposed more inward in the width direction than the first restricting member 810 and the second restricting member 820.

The auxiliary guiding surfaces 870 are formed always at positions retracted from the conveyed sheet 82 more than the first surface 700*a* of the leading rib 700, and guides both sides in the width direction of the sheet 82 guided from the guide surface 920 further downward.

The second restricting member 820 and the third restricting member 830 are rod-shaped members which extend in the sliding direction and have substantially rectangular sections orthogonal to the sliding direction.

By fitting with the cylindrical sliding hole 741 and the cylindrical sliding hole 751, respectively, the second restricting member 820 and the third restricting member 830 restrict movements in all directions orthogonal to the sliding direction of the guiding member 700 via the holes, and support the guiding member 700 slidably in the sliding direction.

In the third restricting member 830, a sliding hole 835 is formed on the projection side, and on the retracting side, a spring seat 840 is formed, and between the sliding hole 835 and the spring seat 840, a spring hole 850 is formed.

As shown in FIG. 18, FIG. 19, and FIG. 22, the sliding hole 835 supports the guiding member 700 slidably in the sliding direction, by fitting the claw 711 of the sliding portion 710, and has a projection side restricting surface 835*a* which restricts movements of the claw 71 to the projection side and a retracting side restricting surface 835*b* which restricts movements of the claw 71 to the retracting side.

On the spring seat 840, as shown in FIG. 18 and FIG. 19, one end of the (compression) coil spring 810 is supported. Herein, the compression coil spring 810 urges the guiding member 700 to the projection side, and the urging force of the coil spring 810 is described herein.

That is, the urging force of the compression coil spring 810 is at a level which does not greatly displace itself even when pushed toward the retracting side via the guiding member 700 by the elasticity (elastic force) of the sheet 82 when a plain paper being low in elasticity as the sheet 82 comes into contact with the guiding member 700.

On the other hand, the urging force of the compression coil spring 810 is limited to the degree at which, when a thick paper with elasticity higher than that of a plain paper as the sheet 82 comes into contact with the guiding member 700, the urging force of the compression coil spring is overcome by the pressing force of the sheet 82 when pushed by the elasticity (elastic force) of the sheet 82 to the retracting side, and the compression coil spring is compressed to move the guiding member 700 to the above-described "retracted position."

The spring hole 850 is a hole in a rectangular shape extending in the sliding direction, and holds the spring 810, apart of the spring seat 820, and apart of the receiving portion 730, and restricts their displacements in the width direction.

[Guide Surface 920]

In the guide surface 920, as shown in FIG. 20, on a width direction central portion thereof, a U-shaped notched portion is formed so as to sandwich the retracting side of the sliding direction of the guiding member 700.

The tip end 923 of the guide surface 920 is formed so as to be inclined downward toward the rear side as shown in FIG. 18, and extends so as to cross the second surface 700*b* of the guiding member 700 in a side view when the guiding member 700 is at the projecting position of the sliding direction.

When a plain paper being low in elasticity is guided as the sheet 82 from the guide surface 920, the tip end portion of the sheet 82 comes into contact with the second surface 700*b*, the corner 700*d* on the boundary between the second surface 700*b* and the first surface 700*a*, and the first surface 700*a* of the guiding member in order as it is conveyed.

When the sheet 82 is in contact with the first surface 700*a*, the first surface 700*a* is pushed by a force F in a direction substantially orthogonal to the first surface 700*a* due to the elasticity of the sheet 82 as shown in FIG. 18. Herein, the force F has a component f directed toward the retracting side of the sliding direction, so that the guiding member 700 is pushed toward the retracting side. However, the guiding member 700 is not greatly displaced by the urging force of the coil spring 810 even when pushed by the elasticity of the plain paper.

Namely, when a plain paper is thus used, the guiding member 700 is always at the "projecting position," so that the plain paper comes into contact with the conveying surface of the belt 96A while its width direction central portion is curved to project toward the conveying surface of the belt due to the contact with the guiding member 700.

On the other hand, when a thick paper being higher in elasticity than that of the plain paper is guided as the sheet 82 by the guide surface 920, as in the case of the plain paper, the first surface 700*a* of the guiding member 700 is subjected to a force F' directed substantially orthogonal to the first surface 700*a* from the sheet 82 due to the elasticity of the sheet 82. Then, the force F' has a component f' directed toward the retracting side of the sliding direction, however, the elasticity of the thick paper is higher than that of the plain paper, so that the strength of the F' is greater than F, and as a result, f' is also greater than f. Therefore, due to the force f∝, the guiding member 700 is displaced from the "projecting position" to the "retracted position" shown in FIG. 19 against the force of the coil spring 810.

When a thick paper is thus used, the sheet 82 comes into contact with the conveying surface of the belt 96A without being greatly curved by the guiding member 700.

When a plain paper being low in elasticity is used as the sheet 82, air is trapped between the sheet 82 and the conveying surface of the belt and easily lowers the image quality, so that the widthwise central portion of the sheet 82 is curved so as to protrude toward the conveying surface of the belt and the sheet is brought into contact with the belt from this central portion.

However, when a thick paper with elasticity higher than that of the plain paper is used, due to the high elasticity of the sheet 82, in particular, the problem of air being trapped between the sheet 82 and the conveying surface of the belt does not occur. On the contrary, when a sheet 82 with such high elasticity is forcibly curved by a force stronger than a predetermined strength, this curve may be hardly restored. That is, when the sheet 82 is fed to the conveying surface of the belt 96A in such a greatly curved state, even after the sheet 82 is placed on the conveying surface and conveyed to a transfer position, it remains curved, and a developing image may not be normally transferred on the sheet 82.

Therefore, when a plain paper is guided as the sheet 82 from the guide surface 920, the guiding member 700 sufficiently curves a central portion of the sheet 82 toward the conveying surface of the belt and then brings it into contact with the conveying surface of the belt, and on the other hand, when a thick paper is guided as the sheet 82 from the guide surface 920, the guiding member 700 shifts to the "retracted position" so as not to greatly curve the sheet.

Thus, when a plain paper is used, air trapped between the conveying surface of the belt and the sheet 82 can be prevented, and when a thick paper is used, the thick paper can be prevented from being excessively curved and lowering the image quality.

A plain paper is used as a sheet being lower in elasticity than that of the thick paper, however, instead of the plain paper, a thin paper with elasticity lower than that of the plain paper may also be used.

<Still Yet Another Example Structure>

Next, still yet another example structure will be described with reference to FIG. 23 through FIG. 27. In the following description, description of the construction substantially the same as in another example structure will be omitted.

A protrusion rib 900 is different from the protrusion rib 270 in that the protrusion rib 900 is supported in a manner enabling it to swing between a position projecting toward a guided sheet 82 and a position retracted from the sheet 82, and this swing is controlled by a CPU.

Figure 23:
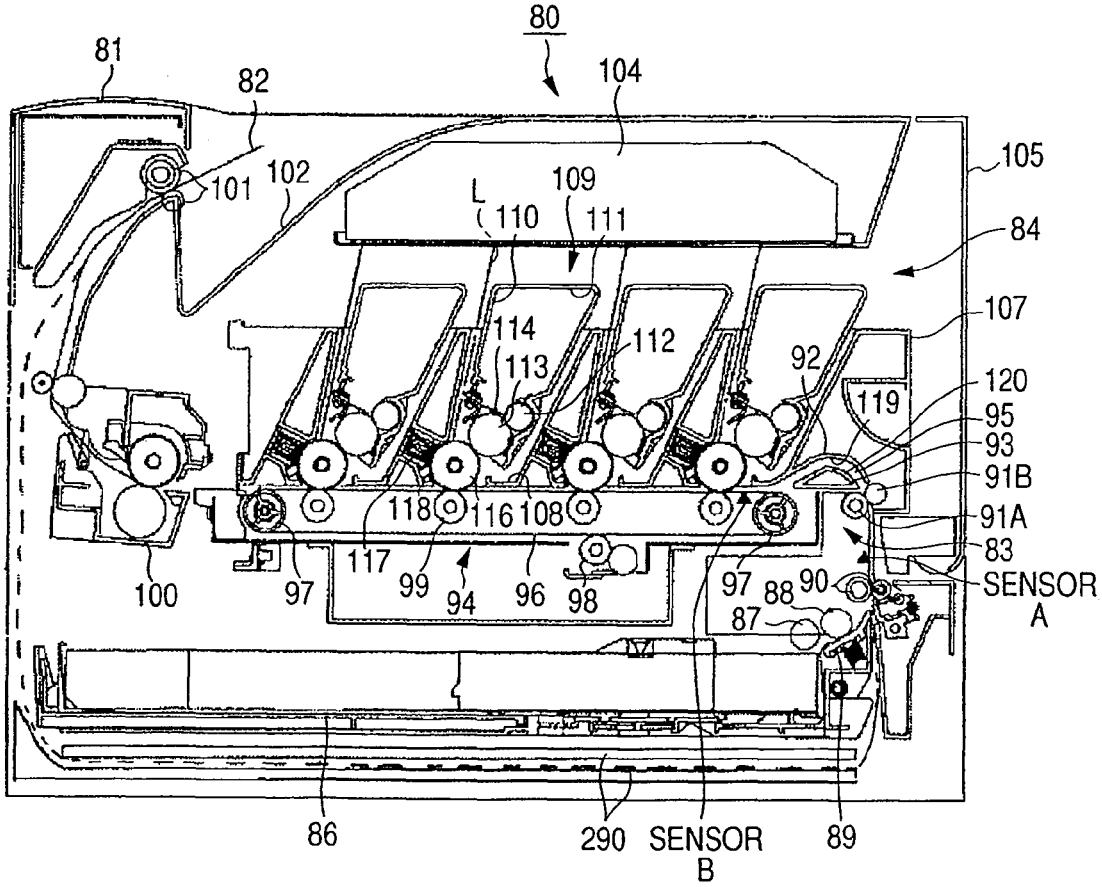
FIG. 23 is an exemplary sectional side view of a laser printer 80.

The laser printer 80 comprises, as shown in FIG. 23, a sensor A which is disposed on the more upstream side in the conveying direction of the sheet 82 than the resist rollers 91A and 91B and detects passing of the tip end portion of the sheet 82, and a sensor B (see FIGS. 24A, 24B) which is disposed on the more downstream side in the conveying direction than the protrusion rib 900 and detects passing of the rear end of the sheet 82.

The protrusion rib 900 has, as shown in FIGS. 24A, 24B and FIGS. 25A, 25B, a guiding surface 900*a* which is shaped into a wedge shape in a side view and guides a sheet 82 conveyed from the guide surface 119 to the conveying surface of the belt 96A, and a swing shaft 900*b* supported on the frame 107 on the upstream side in the conveying direction in a manner enabling it to swing.

Figure 24A:
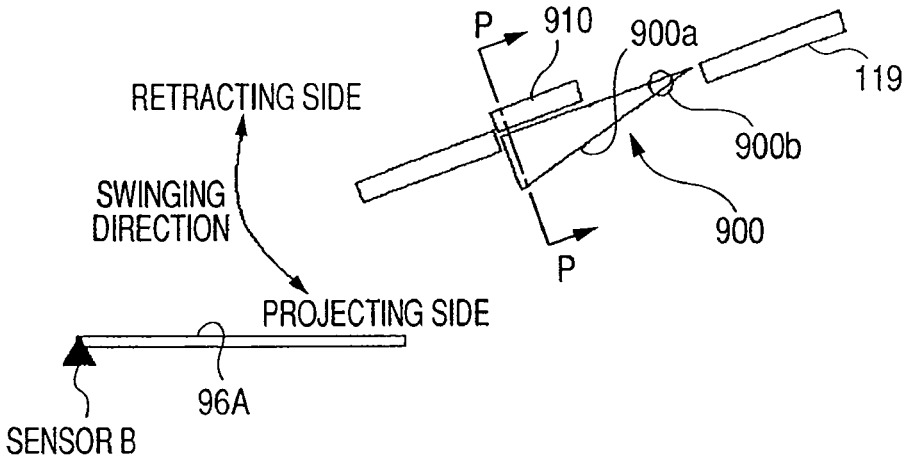
FIG. 24A is an exemplary sectional side view showing a state that the protrusion rib 900 is at the "projecting position.
Figure 24B:
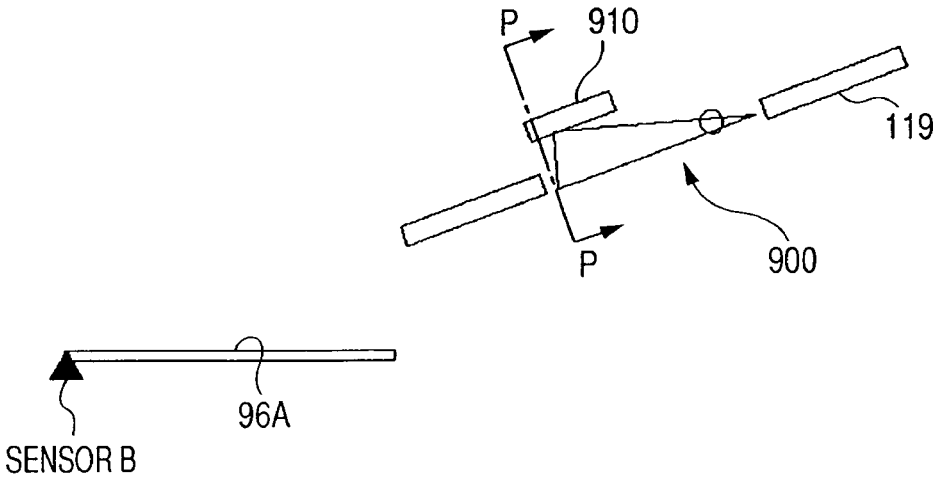
" and FIG. 24B is an exemplary sectional side view showing a state that the protrusion rib 90 is at the "retracted position;"

With this construction, as shown in FIG. 24A and FIG. 24B, the protrusion rib 900 can swing around the swing shaft 900*b* between the "projecting position" at which the guiding surface 900*a* projects toward the surface of the sheet 82 conveyed from the guide surface 119 and the "retracted position" at which the guiding surface 900*a* is retracted from the surface of the sheet 82. Herein, as shown in FIGS. 24A, 24B, in the swinging direction, the side of the "projecting position" is referred to as "projection side," and the side of the "retracted position" is referred to as "retracting side."

Figure 25A:
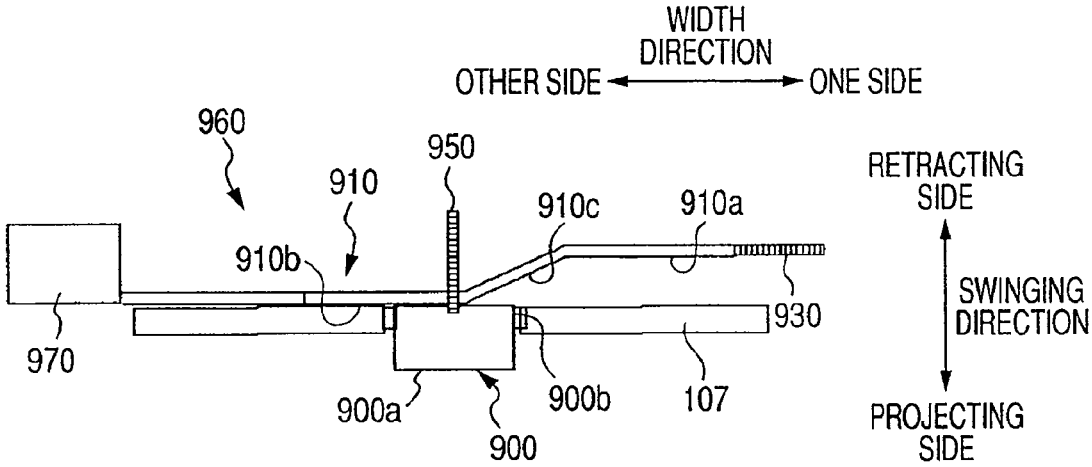
FIG. 25A is an exemplary sectional view along the arrow P-P of FIG. 24A, showing the state that the protrusion rib 900 is at the "projecting position.
Figure 25B:
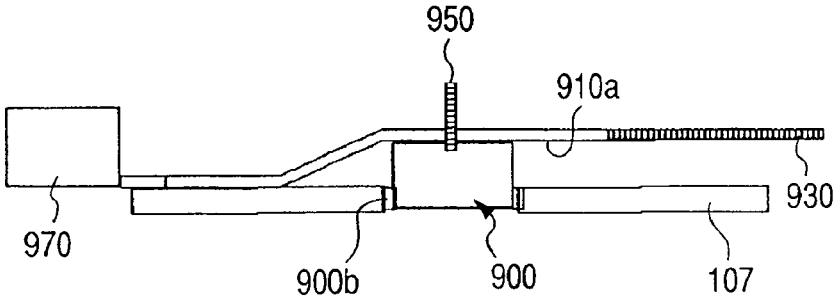
" and FIG. 25B is an exemplary sectional view along the arrow P-P of FIG. 24B, showing the state that the protrusion rib 900 is at the "retracted position;"

To the opposite side of the guiding surface 900*b* of the protrusion rib 900, as shown in FIGS. 25A, 25B, the other end portion of a tension coil spring 950 having one end fixed to the frame 107 is fixed. With this construction, the protrusion rib 900 is urged toward the "retracting side" by the tension coil spring 950.

With the opposite side of the guiding surface 900*a* of the protrusion rib 900, a switching member 960 for switching the position of the protrusion rib 900 to either the "projecting position" or the "retracted position" is in contact.

The switching member 960 has a cam 910 that comes into contact with the opposite surface of the guiding surface 900*a* of the protrusion rib 900, a tension coil spring 930 disposed on one side in the width direction of the cam 910, and a solenoid 970 disposed on the other end side in the width direction of the cam 910.

The cam 910 is supported on the frame 107 slidably movably in the width direction, and has a projecting surface 910*b* projecting toward the projection side on the other side in the width direction, a retracted surface 910*a* retracted to the retracting side more than the projecting surface 910*b* on one side in the width direction, and an inclined surface 910*c* which extends in an inclined manner with respect to the width direction and joins the projecting surface 910*b* and the retracted surface 910*a*.

The tension coil spring 930 has one end fixed to the frame 107 and the other end fixed to the cam 910, and urges the cam 910 toward one side in the width direction.

The solenoid 970 is fixed to the cam 910, and when the solenoid is ON, it urges the cam 910 toward the other side in the width direction, and when it is OFF, the solenoid releases this urging force. Herein, the ON state of the solenoid 970 means a state that power is supplied to the solenoid 970, and the OFF state of the solenoid 970 means a state that no power is supplied to the solenoid 970. With this construction of the solenoid, when the solenoid 970 is OFF, the cam 910 is supported at a position at which the projecting surface 910*b* comes into contact with the protrusion rib 900 by the urging force of the tension coil spring 930 as shown in FIG. 25A. On the other hand, when the solenoid 970 is ON, the urging force of the solenoid 970 overcomes the urging forces of the tension coil spring 950 and the tension coil spring 970, whereby the cam 910 slides and moves to the position at which the retracted surface 900*a* comes into contact with the protrusion rib 900 as shown in FIG. 25B.

Figure 26:
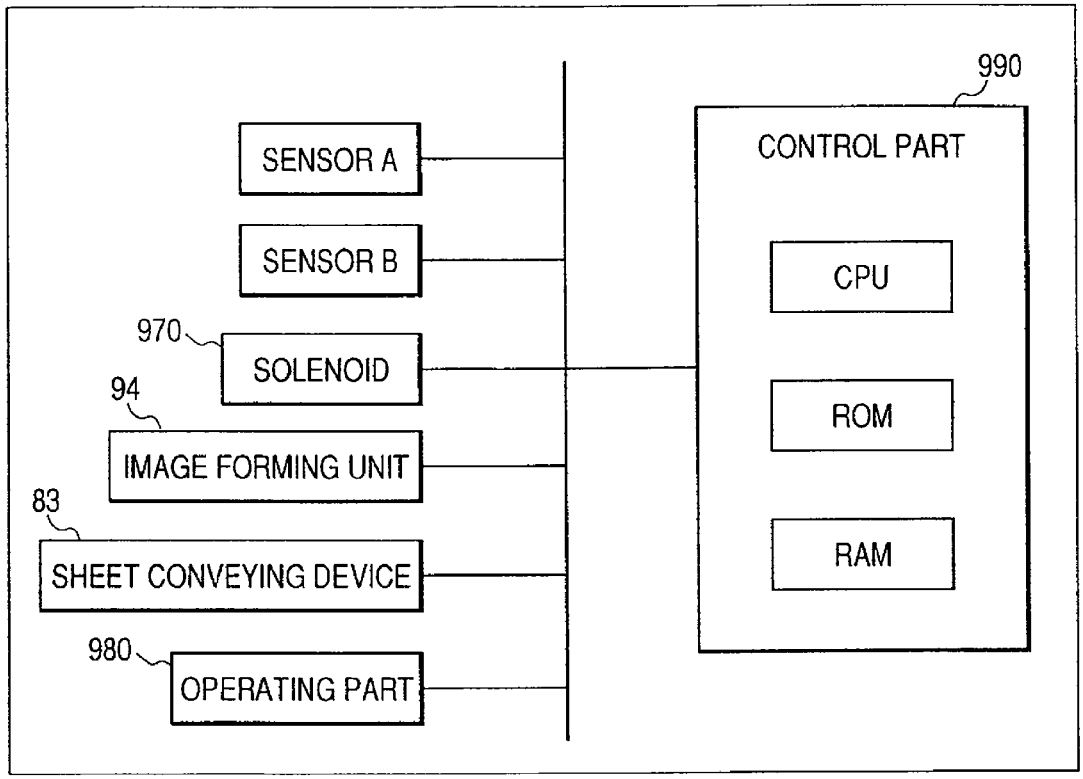
FIG. 26 is an exemplary block diagram of a laser printer 80.
Figure 27:
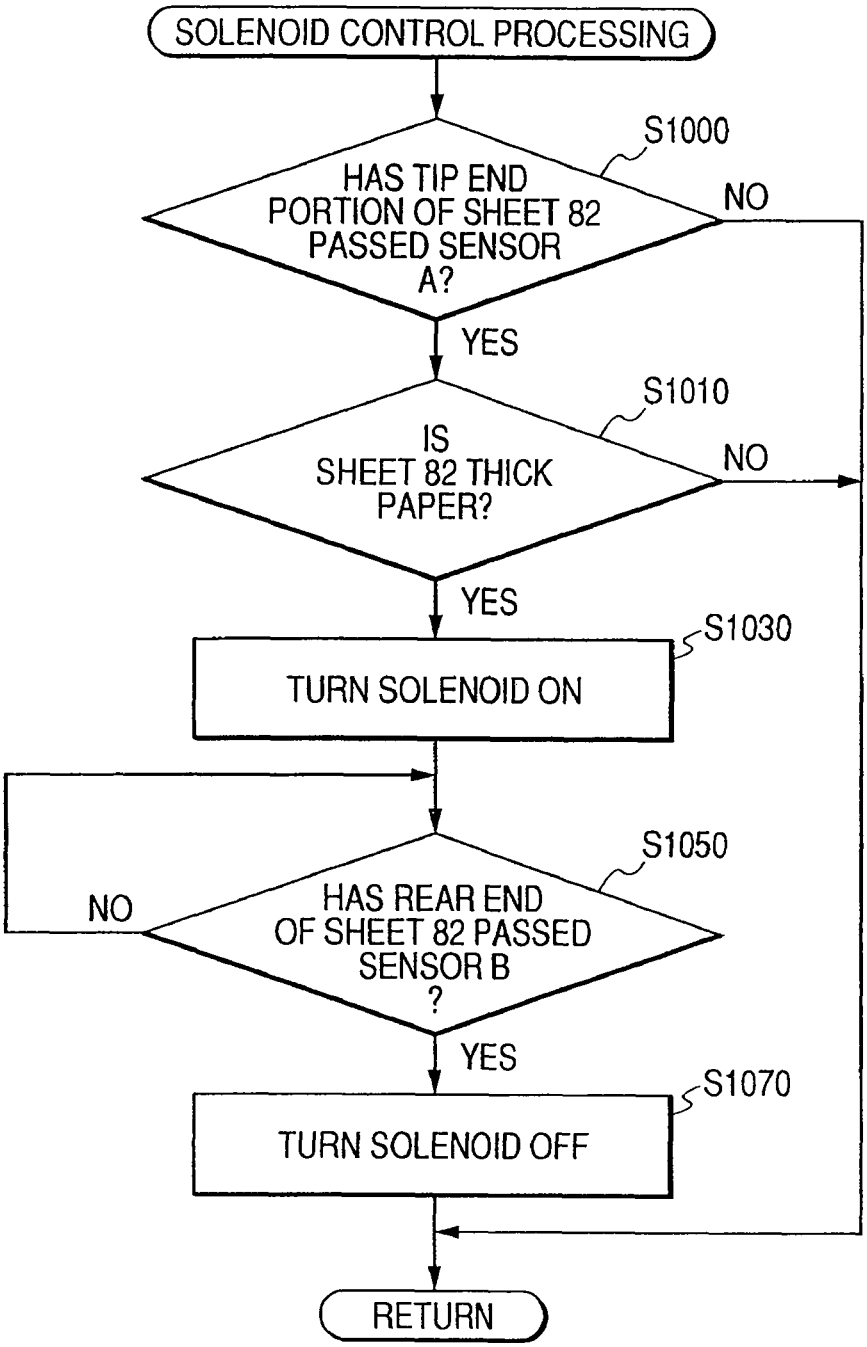
FIG. 27 is an exemplary flowchart showing solenoid control processing.

The laser printer 80 further includes, as shown in FIG. 26, a control part 990 for generally controlling the entirety of the apparatus, and an operating part 980 having operation keys (not shown), etc., that a user can operate. To the control part 990, the operating part 980, the sensor A, the sensor B, the solenoid 970, the image forming unit 94, the sheet conveying device 83, and the operating part 980, etc., are electrically connected.

The control part 990 includes a CPU for performing various arithmetic operations, a ROM for storing various programs to be executed by the CPU, and a RAM to be used as a work area when a program is executed by the CPU. The control part 990 realizes image forming through the image forming unit 94 by executing various programs by the CPU.

The operating part 980 accepts a selection as to whether the sheet 82 on which an image will be formed is a plain paper or a thick paper according to an input operation performed on operation keys by a user. Herein, the thick paper means a sheet being higher in elasticity than that of the plain paper. The result of selection between the plain paper and the thick paper is transmitted as an electrical signal to the control part 990.

When the sensor A detects passing of the tip end portion of the sheet 82, the result of this detection is transmitted as an electrical signal to the control part 990, and in the control part 990, a sensor A passing flag is turned ON.

When the sensor B detects passing of the rear end of the sheet, the result of this detection is transmitted as an electrical signal to the control part 990, and in the control part 990, the sensor B passing flag is turned ON.

This solenoid control processing is executed by the CPU of the control part 990, and is started every predetermined time (for example, every 0.1 second) in a state that the power source of the laser printer 80 is ON.

When this solenoid control processing is started, the CPU of the control part 990 judges whether the tip end portion of the sheet 82 has passed through the sensor A (S1000).

Then, at S1000, when it is judged that the tip end portion of the sheet 82 has not passed through the sensor A (No at S1000), this solenoid control processing is ended.

On the other hand, when it is judged that the tip end portion of the sheet 82 has passed (the sensor A flag is ON) (Yes at S1000), the process shifts to S1010.

When the process shifts to S1010, the sensor A passing flag is turned OFF, and when it is judged that a thick paper is not set as the sheet 82 to be used in the operating part 980, that is, when it is judged that a normal paper has been set (No at S1010), this solenoid control processing is ended.

On the other hand, when it is judged that a thick paper is used (Yes at S1010), the process shifts to S1030.

When the process shifts to S1030, the solenoid 970 is turned ON.

When the solenoid 970 is thus turned ON, the cam 910 is urged toward the other side in the width direction by the solenoid 970, and slides and moves from the position shown in FIG. 25B at which the projecting surface 910*b* comes into contact with the protrusion rib 900 to the position shown in FIG. 25B at which the retracted surface 910*a* faces the protrusion rib 900.

In this sliding movement, the protrusion rib 900 is urged to the retracting side by the tension spring 950 and moves to the retracted position while rubbing against the inclined surface 910*c*. As a result, as shown in FIG. 24B, the guiding surface 900*a* is at the position retracted from the surface of the conveyed sheet 82 (thick paper), so that the sheet 82 that is a thick paper is guided to the conveying surface of the belt 96A without being greatly curved.

When the processing of S1030 is thus finished, the process shifts to S1050 and waits until the rear end of the sheet 82 is detected by the sensor B, and when it is judged that the rear end of the sheet 82 was detected by the sensor B (the sensor B flag is ON) (Yes at S1050), the process shifts to S1070.

When the process shifts to S1070, the sensor B passing flag is turned OFF, and the solenoid 970 is turned OFF.

When the solenoid is thus turned OFF, the urging force of the solenoid 970 to urge the cam 910 is released, and the cam 910 is urged to one side in the width direction by the tension coil spring 930. Thus, the cam 910 slides and moves from the position shown in FIG. 25B at which the retracted surface 910*a* comes into contact with the protrusion rib 900 to the position shown in FIG. 25B at which the projecting surface 910*b* comes into contact with the protrusion rib 900.

In this sliding movement, the protrusion rib 900 moves to the projecting position while rubbing against the inclined surface 910*c* as shown in FIG. 24A.

When a plain paper being low in elasticity is used as the sheet 82, air is trapped between the sheet 82 and the conveying surface of the belt 96A and easily lowers the image quality, so that the widthwise central portion of the sheet 82 is curved so as to protrude toward the conveying surface of the belt 96A and the sheet is brought into contact with the conveying surface of the belt 96A from the central portion.

However, when a thick paper being higher in elasticity than that of a plain paper is used as the sheet 82, due to the high elasticity of the sheet 82, the problem in particular of air being trapped between the sheet 82 and the conveying surface of the belt does not occur. On the contrary, if the sheet 82 being of such high elasticity is forcibly curved by a force stronger than a predetermined strength, the curvature may be hardly restored. That is, if the sheet 82 is fed to the conveying surface of the belt while remaining greatly curved, even after the sheet 82 is conveyed on the conveying surface to the transfer position, it is left curved, and a developing image may not be normally transferred on the sheet 82.

Therefore, when a plain paper is guided as the sheet 82 from the guide surface 920, the guiding member 700 sufficiently curves the central portion of the sheet 82 toward the conveying surface of the belt and then brings it into contact with the conveying surface of the belt, and on the other hand, when a thick paper is guided as the sheet 82 from the guide surface 920, the guiding member 700 is displaced to the "retracted position" so as not to greatly curve the sheet.

Thus, when a plain paper is used, air trapped between the conveying surface of the belt and the sheet 82 can be prevented, and when a thick paper is used, the thick paper can be prevented from being excessively curved and causing a lowering in image quality.

Setting of a thick paper or a plain paper is made through the operating part 980, however, it is also possible to detect whether the sheet is a thick paper or a plain paper by a sensor.

<Further Still Yet Another Example Structure>

Figure 28:
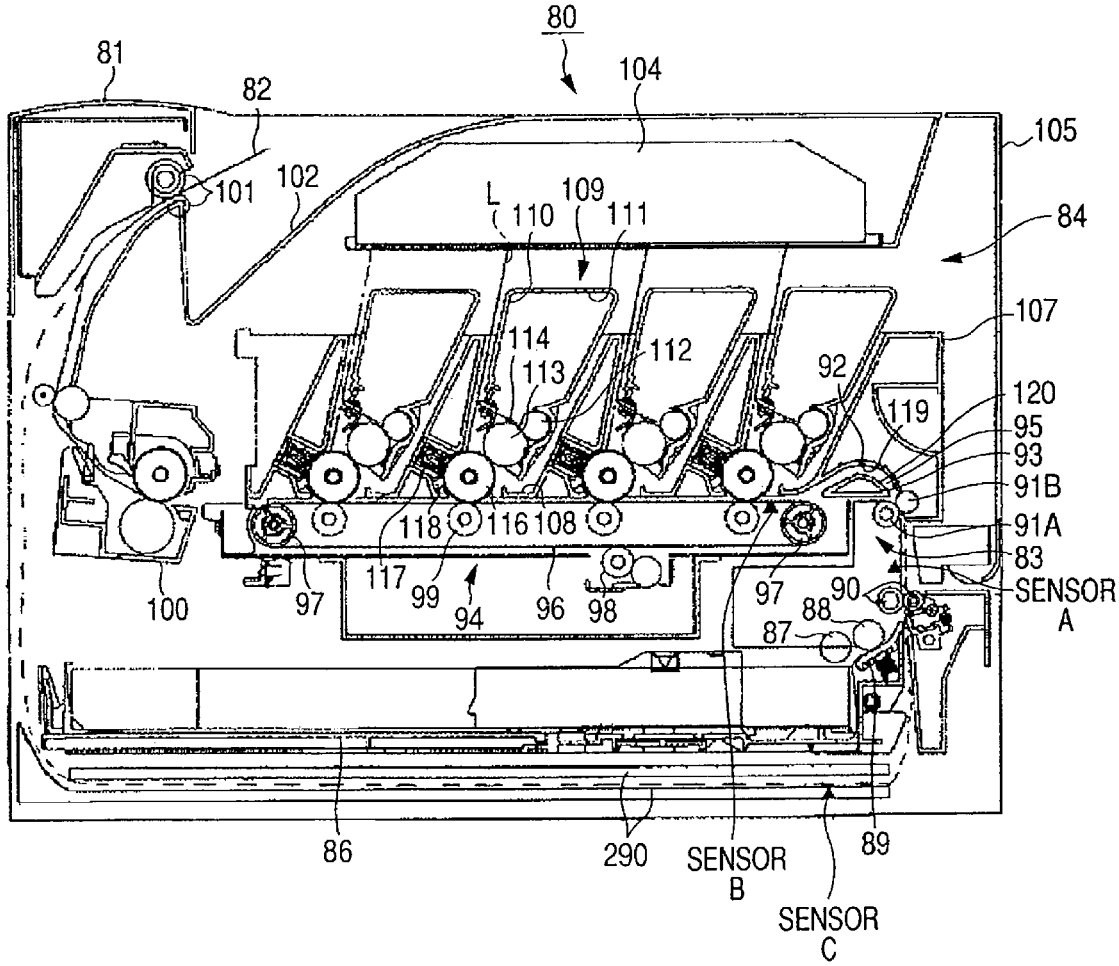
FIG. 28 is an exemplary sectional side view of a laser printer 80.
Figure 29:
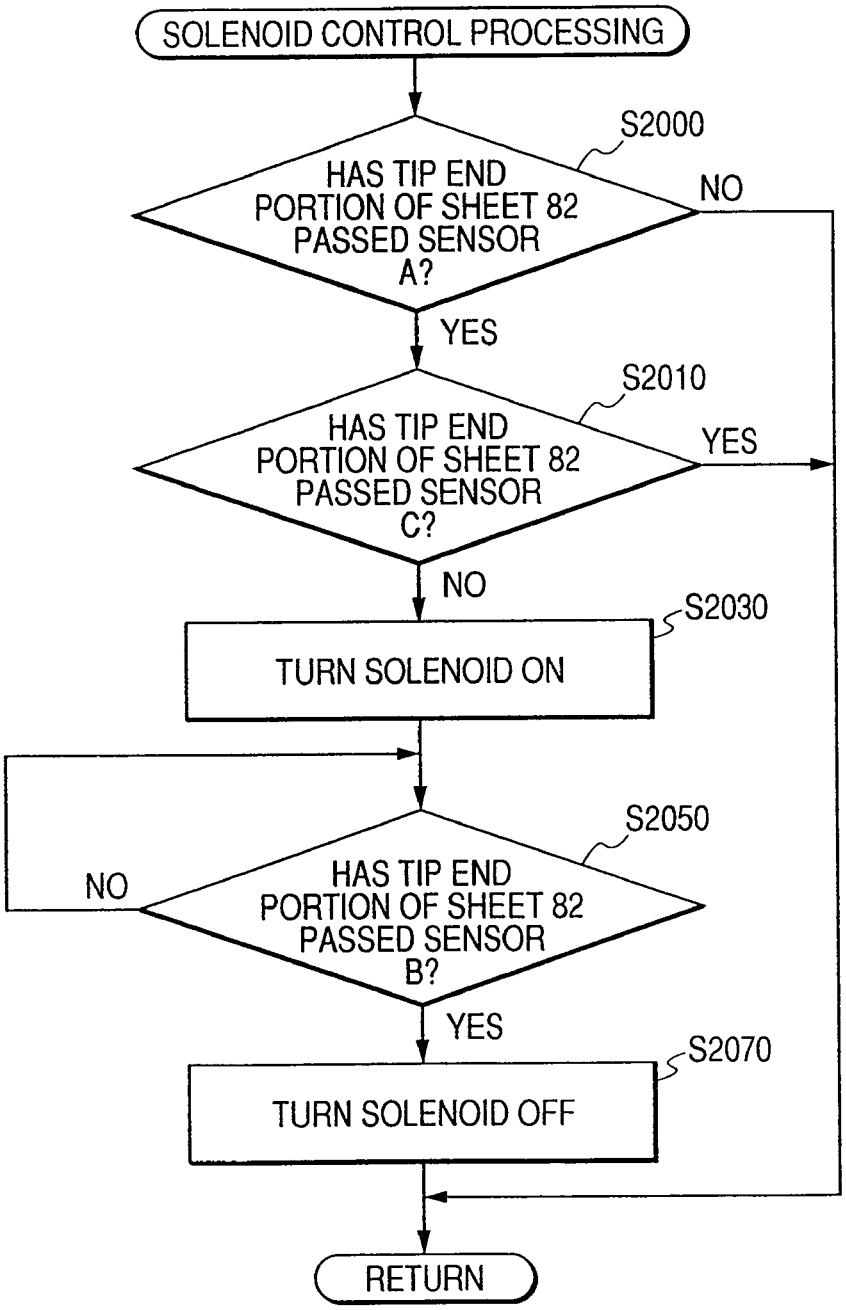
FIG. 29 is an exemplary flow chart showing solenoid control processing.

Next, further yet still another example structure will be described with reference to FIG. 28 and FIG. 29. In the following description, description of the construction substantially the same as in still yet another example structure will be omitted.

The still yet another example structure is constructed so that the protrusion rib 900 is at the "projecting position" when a plain paper is used as the sheet 82, and is at the "retracted position" when a thick paper is used as the sheet 82.

Instead of said construction, the protrusion rib 900 is positioned at the "retracted position" when an image is formed on a first surface of the sheet 82, and is positioned at the "projecting position" when an image is formed on a second surface of the sheet 82.

Herein, the first surface of the sheet 82 means either of the front or back surface of the sheet 82 in a state that an image is formed on neither the front nor back surface, and the second surface of the sheet 82 means a surface opposite the first surface in a state that an image is formed on the first surface.

In the mechanical construction, the re-conveying mechanism 290 is provided with a sensor C that detects the tip end portion of the sheet 82. The sensor C is electrically connected to the control part 990, and when passing of the tip end portion of the sheet 82 is detected by the sensor C, the result of this detection is transmitted to the control part 990, and a sensor C passing flag is turned ON in the control part 990.

This solenoid control processing is started every predetermined time (for example, every 0.1 second) in a state that the power source of the laser printer 80 is ON.

When this solenoid control processing is started, the CPU of the control part 990 judges whether the tip end portion of the sheet 82 has passed through the sensor A (S2000).

Then, at S2000, when it is judged that the tip end portion of the sheet 82 has not passed through the sensor A (No at S2000), this solenoid control processing is ended.

On the other hand, when it is judged that the tip end portion of the sheet 82 has passed through the sensor A (the sensor A passing flag is ON) (Yes at S2000), the process shifts to S2010.

When the process shifts to S2010, the sensor A passing flag is turned OFF, and when it is judged that the tip end portion of the sheet 82 has passed through the sensor C (sensor C passing flag is ON), that is, it is judged that an image has already been formed on the first surface of the sheet 82 and the sheet 82 is being conveyed for image forming on the second surface (Yes at S2010), the sensor C passing flag is turned OFF and this solenoid control processing is ended.

On the other hand, when it is judged that the tip end portion of the sheet 82 has not passed through the sensor C, that is, it is judged that the sheet 82 is being conveyed for image forming on the first surface (No at S2010), the process shifts to S2030.

When the process shifts to S2030, the solenoid 970 is turned ON.

When the solenoid 970 is thus turned ON, the protrusion rib 900 moves from the "projecting position" to the "retracted position." As a result, when an image is formed on the first surface of the sheet 82, the guiding surface 900*a* is at the position retracted from the surface of the conveyed sheet 82, so that the sheet 82 is guided to the conveying surface of the belt 96A without being greatly curved.

When the processing of S2030 is thus finished, the process shifts to S2050 and waits until the sensor B detects the rear end of the sheet 82, and when it is judged that the rear end of the sheet 82 was detected by the sensor B (the sensor B passing flag is ON) (Yes at S2050), the process shifts to S2070.

When the process shifts to S2070, the sensor B passing flag is turned OFF, and the solenoid 970 is turned OFF.

When the solenoid is thus turned OFF, the protrusion rib 900 moves from the "retracted position" to the "projecting position." As a result, when an image is formed on the second surface of the sheet 82, the central portion of the sheet 82 is sufficiently curved so as to protrude toward the conveying surface of the belt 96A, and is guided toward the conveying surface of the belt 96A.

When the sheet 82 is guided to the conveying surface of the belt 96A for image forming on the first surface, an image has not been formed yet, so that the flatness of the surface of the sheet 82 is high, and the possibility of air being trapped between the conveying surface of the belt 96A and the surface of the sheet 82 may be slight. In this case, in image forming on the first surface, to avoid burden on the sheet 82, it may be desirable to avoid the above-described curving of the central portion of the sheet 82.

On the other hand, when the sheet 82 is guided to the conveying surface of the belt 96A for image forming on the second surface, an image has already been formed on the first surface, so that the flatness of the surface of the sheet 82 has lowered, so that it is highly possible that air is trapped between the conveying surface of the belt 96A and the sheet 82. Therefore, in the case of image forming on the second surface of the sheet 82, before the sheet 82 comes into contact with the conveying surface of the belt 96A, it is desirable that the central portion of the sheet 82 is curved so as to protrude toward the conveying surface of the belt 96 as described above.

In the case of image forming on the first surface of the sheet 82, the protrusion rib 900 is at the "retracted position," so that the sheet 82 is not greatly curved. As a result, an undesirable burden on the sheet 82 can be avoided.

On the other hand, in the case of image forming on the second surface of the sheet 82, the protrusion rib 900 is on the "projecting position," so that the central portion of the sheet 82 is sufficiently curved so as to protrude toward the conveying surface of the belt 96A, and therefore, air being trapped between the conveying surface of the belt 96A and the surface of the sheet 82 is prevented.

According to the above-described example structures, when a recording sheet is guided by the guiding member while being curved, the recording sheet can be guided to the belt so that, first, the width direction central portion that was curved and protruded toward the conveying surface side of the recording sheet comes into contact with the conveying surface of the belt, and the contact area gradually spreads to both end sides in the width direction of the recording sheet while being conveyed, and air between the conveying surface of the belt and the recording sheet is expelled to both end sides.

In addition, the guiding member for leading the tip end portion of the recording sheet toward the conveying surface of the belt is in contact with a surface of the recording sheet opposite a surface facing the conveying surface of the belt, so that the tip end portion of the recording sheet is restricted from warping in a direction of separating from the conveying surface of the belt, and is brought into contact with the conveying surface of the belt more reliably than in the construction described in Patent Document 1. As a result, it can be prevented that air is trapped between the tip end portion of the recording sheet and the conveying surface of the belt and lowers the quality of an image formed on the recording sheet surface.

According to the above-described example structures, the tip end portion of the recording sheet is fed to the guide member recessed into a concave shape by the conveying rollers, so that the tip end portion of the recording sheet becomes difficult to separate from the guide member while being conveyed to reach the downstream side of the guide member, and the tip end portion of the recording sheet can be more reliably guided to the guiding member.

According to the above-described example structures, the recording sheet bends between the belt and the conveying rollers, and a surface of the recording sheet opposite a surface facing the conveying surface of the belt becomes easier to more reliably come into contact with the conveying surface of the belt due to a guide member recessed into a concave shape. As a result, by more reliably guiding this surface by the guiding member, the width direction central portion of the surface in the recording sheet conveying direction is more reliably protruded toward the conveying surface of the belt, and it can be more reliably prevented that air is trapped between the surface and the conveying surface of the belt.

According to the above-described example structures, the rib can be made smaller in area in contact with the recording sheet when compared with that spreading like a plate and conveying resistance to the recording sheet can be reduced. As a result, jamming of recording sheets can be further prevented.

According to the above-described example structures, smooth conveyance is realized, so that the possibility that the conveying resistance suddenly increases and jamming occurs can be reduced.

According to the above-described example structures, the rotary body rotatably supported can rotate in a direction of releasing a contact force of a recording sheet when the recording sheet comes into contact, so that the conveying resistance to the recording sheet can be reduced. As a result, jamming of recording sheets can be further prevented.

According to the above-described example structures, a recording sheet is conveyed between the guiding member and the auxiliary guiding member, so that the behavior of the recording sheet is stabilized.

According to the above-described example structures, the auxiliary guiding member and the belt are integrally formed, so that positional accuracy with respect to the belt increases, and a recording sheet is more reliably guided to the conveying surface of the belt.

In addition, by detaching the belt from the image forming apparatus main body, a recording sheet jamming at the auxiliary guiding member can be more easily removed.

According to the above-described example structures, in this electrophotographic image forming apparatus, when air is trapped between the conveying surface of the belt and a recording sheet, void may occur, however, the present invention is constructed so that air is hardly trapped between the recording sheet and the conveying surface of the belt as described above, so that occurrence of such a void can be prevented.

According to the above-described example structures, in such a so-called tandem image forming apparatus, a void can be further prevented as described above.

According to the above-described example structures, the photosensitive member and the guiding member are integrally provided via a frame, so that the positional accuracy of the guiding member with respect to the photosensitive member is improved, and it becomes possible to accurately guide a recording sheet to the belt facing the photosensitive member.

In addition, by detaching the frame from the image forming apparatus main body, a recording sheet jamming at the guiding member can be easily removed.

According to the above-described example structures, by electrostatically adsorbing a recording sheet by the conveying surface of the belt, it becomes possible to reliably bring the recording sheet into close contact with the conveying surface of the belt, and on the other hand, when air is trapped between the recording sheet and the belt, around the air, the belt and the recording sheet are in close contact with each other, so that air is hardly released. However, in the present invention, as described above, in the process of bringing the recording sheet into contact with the conveying surface of the belt, air between the sheet and the conveying surface of the belt is released, so that trapping of air between the recording sheet and the conveying surface of the belt can be prevented.

According to the above-described example structures, a surface of a sheet conveyed by the re-conveying mechanism opposite a surface on which an image has already been printed comes into contact with the guiding member, so that a possibility that the printed surface is stained or toner scatters from the surface can be reduced.

According to the above-described example structures, the conveying rollers which feed-out the recording sheet to the belt side are resist rollers which correct the tip end portion of the recording sheet, so that other resist rollers are not necessary, and the construction becomes simple.

According to the above-described example structures, a contact angle of the tip end portion of the recording sheet with the guide member is set so as to be always not more than 45 degrees. When the tip end portion of the recording sheet is pressed against the guide member at a great contact angle, the load on the recording sheet increases, and the tip end portion of the recording sheet may be damaged, however, according to the present construction, the tip end portion of the recording sheet comes into contact with the guide member always at a gentle angle, so that the recording sheet can be prevented from being damaged.

According to the above-described example structures, a feed-out direction of a recording sheet from the conveying rollers is inclined toward a recording sheet conveying direction on the belt more than the direction orthogonal to the recording sheet conveying surface of the belt. Thereby, even when the apparatus is downsized, curvature of the recording sheet in the recording sheet conveying path can be reduced.

When a recording sheet being low in elasticity is used, air is trapped between the recording sheet and the conveying surface of the belt and easily lowers the image quality, so that it is desirable that the width direction central portion of the recording sheet is curved so as to protrude toward the conveying surface of the belt, and the recording sheet is brought into contact with the belt from this central portion.

However, when a recording sheet being high in elasticity is used, due to the high elasticity of the recording sheet, the recording sheet is hardly creased and trapping of air between the recording sheet and the conveying surface of the belt hardly occurs. On the other hand, if such a recording sheet being high in elasticity is forcibly curved by a force stronger than a predetermined force, this curve may be hardly restored. When such a recording sheet is fed to the conveying surface of the belt in this greatly curved state, even after the recording sheet is placed on the conveying surface and conveyed to a transfer position, it remains curved, and a developing image may not be normally transferred onto the recording sheet. Accordingly, when such a recording sheet being high in elasticity is used, it is desirable that the recording sheet is not greatly curved.

According to the above-described example structures, when a recording sheet being low in elasticity comes into contact with the guiding member, the guiding member is pressed to a retracted position due to the elasticity (elastic force) of the recording sheet, however, this pressing force is overcome by the urging force of the urging unit and the guiding member is not displaced to the retracted position. As a result, the width direction central portion of the recording sheet is sufficiently curved by the guiding member so as to protrude toward the conveying surface of the belt. Thereby, it becomes possible to prevent that air is trapped between the recording sheet and the conveying surface of the belt and lowers the image quality.

On the other hand, when a recording sheet being high in elasticity comes into contact with the guiding member, the guiding member is pressed to the retracted position by the elasticity (elastic force) of the recording sheet, and the pressing force overcomes the urging force of the urging unit and the guiding member is displaced to the retracted position. As a result, the recording sheet is prevented from being excessively curved. Thus, it becomes possible to prevent that an image is formed by the image forming unit while leaving the recording sheet high in elasticity curved and lowered in quality.

<Other Example Structures>

The present invention is not limited to the above-described example structures, and for example, the following example structures are also included in the technical scope of the invention, and moreover, other than the following example structures, the invention can also be carried out by being variously changed without deviating from the aspects of the invention. As a recording sheet on which an image may be recorded, other than the sheets, OHP plastic sheets or fabric sheets may be used. As the cartridge, a cartridge including a photosensitive drum and a developing device (developing cartridge) is shown in the example structure, and a cartridge including only a developing device is shown, however, it is also possible that the cartridge is separated from the developing device and provided with only a photosensitive drum.

What is claimed is:

1. An image forming apparatus comprising:

a belt having a conveying surface on which a recording sheet is configured to be conveyed;

an image forming unit disposed opposite to the belt, the image forming unit configured to form an image on a surface of the recording sheet conveyed by the belt;

a conveying unit configured to convey the recording sheet onto the belt; and a first guiding member disposed opposite to the conveying surface of the belt and configured to at least partly guide the recording sheet toward the conveying surface of the belt while the first guiding member comes into contact with a first surface opposite to a second surface of the recording sheet which comes into contact with the conveying surface of the belt, the recording sheet being guided by the first guiding member while the recording sheet is bent at a center of a tip end portion thereof with respect to a width direction orthogonal to a conveying direction of the recording sheet so as to protrude toward the conveying surface of the belt, wherein the first guiding member remains separated from the belt by a distance greater than the thickness of the recording sheet;

a second guiding member configured to at least partly guide the recording sheet toward the first guiding member while the second guiding member contacts with the first surface opposite to the second surface of the recording sheet;

a shaft extending in a width direction of the image forming apparatus; and an auxiliary guiding member disposed opposite to the first guiding member, wherein the auxiliary guiding member includes at least one rib which faces the first guiding member and protrudes in a direction orthogonal to the conveying direction of the recording sheet so as to be configured to contact the second surface of the recording sheet, wherein the first guiding member includes a plurality of ribs which protrude in a direction orthogonal to the conveying direction of the recording sheet so as to be configured to contact the first surface of the recording sheet, wherein the plurality of ribs includes a first rib provided at a center portion of the recording sheet in a width direction of the recording sheet and a second rib provided at a side portion of the center portion in the width direction, wherein a protrusion amount of the first rib is larger than that of the second rib, wherein a contact angle of the tip end portion of the recording sheet with the second guiding member is set to be equal to or less than 45 degrees, wherein the second guiding member includes a first terminal end at an upstream end of the second guiding member, relative to the conveying direction of the recording sheet, and a second terminal end at a downstream end of the second guiding member, relative to the conveying direction of the recording sheet, and wherein the second guiding member is configured to engage with the shaft closer to the first terminal end of the second guiding member than the second terminal end of the second guiding member such that the second guiding member is rotatable around the shaft.

2. The image forming apparatus according to claim 1, wherein the conveying unit comprises;

a conveying roller disposed on an upstream side of the first guiding member along the conveying direction of the recording sheet and configured to convey the recording sheet to the belt, wherein the second guiding member is configured to at least partly guide the recording sheet conveyed by the conveying roller toward the first guiding member while the second guiding member contacts with the first surface opposite to the second surface of the recording sheet, and the second guiding member has such a concave shape that the second guiding member gradually separates from and approaches the conveying surface of the belt in a direction orthogonal to the conveying surface of the belt from an upstream side to a downstream side with respect to the conveying direction of the recording sheet.

3. The image forming apparatus according to claim 2, wherein a speed at which the recording sheet is conveyed by the conveying roller is set to be higher than a speed at which the recording sheet is conveyed by the belt.

4. The image forming apparatus according to claim 2, wherein the conveying roller is a resist roller configured to correct the tip end portion of the recording sheet.

5. The image forming apparatus according to claim 2, wherein a feed-out direction of the recording sheet from the conveying roller is inclined toward the conveying direction of the recording sheet on the belt more than a direction orthogonal to the conveying surface of the belt.

6. The image forming apparatus according to claim 1, wherein a protrusion amount of the first rib is configured to gradually increase from the upstream side toward the downstream side along the conveying direction of the recording sheet.

7. The image forming apparatus according to claim 1, wherein the first guiding member comprises a rotary body rotatably supported at a position configured to be opposite to a center of the recording sheet with respect to the width direction of the recording sheet orthogonal to the conveying direction of the recording sheet, the rotary body protruding so as to come into contact with the first surface opposite to the second surface of the recording sheet which is opposed to the conveying surface of the belt.

8. The image forming apparatus according to claims 1, wherein the auxiliary guiding member is configured to guide the tip end portion of the recording sheet toward the conveying surface of the belt by coming into contact with the second surface opposite to the first surface of the recording sheet which comes into contact with the first guiding member.

9. The image forming apparatus according to claim 8, wherein the belt is detachable from a main body of the image forming apparatus and the auxiliary guiding member is integrally provided with the belt.

10. The image forming apparatus according to claim 1, wherein the image forming unit comprises:

at least one photosensitive member on which a developing image is configured to be formed being disposed opposite to the conveying surface of the belt;

an exposing unit configured to expose a surface of the photosensitive member to form an electrostatic latent image on the surface of the photosensitive member;

a developing unit configured to form a developing image that forms an electrostatic latent image by supplying a developer onto the surface of the photosensitive member on which the electrostatic latent image is formed; and a transfer unit configured to transfer the developing image formed on the surface of the photosensitive member onto the surface of the recording sheet conveyed on the conveying surface of the belt when applied with a transfer bias.

11. The image forming apparatus according to claim 10, wherein the at least one photosensitive member comprises a plurality of photosensitive members that are disposed along the conveying direction of the recording sheet.

12. The image forming apparatus according to claim 10, wherein, in the image forming unit, the at least one photosensitive member is supported by a frame detachably provided in a main body of the image forming apparatus, and wherein the first guiding member is provided integrally with the frame.

13. The image forming apparatus according to claim 1, comprising:

an electrostatic adsorbing unit configured to electrostatically adsorb the recording sheet guided by the first guiding member by the conveying surface of the belt when applied with a bias.

14. The image forming apparatus according to claim 1, comprising:

a re-conveying mechanism configured to reverse the recording sheet on which an image is formed by the image forming unit and to feed back the recording sheet to the conveying unit.

15. The image forming apparatus according to claim 1, wherein the first guiding member is displaceably supported between a first position where the first guiding member is projected toward a surface of the conveyed recording sheet and a second position where the first guiding member is retracted farther than the first position from the surface of the recording sheet, and wherein the first guiding member comprises an urging unit that urges the first guiding member toward the first position.

16. The image forming apparatus according to claim 1, wherein the first guiding member is displaceably supported between a first position where the first guiding member is projected toward the surface of the conveyed recording sheet and a second position where the first guiding member is retracted farther than the first position from the surface of the recording sheet, wherein the first guiding member is at the first position when contacted by a sheet being as low in elasticity as the recording sheet, and wherein the first guiding member is at the second position when contacted by a sheet being higher in elasticity than that the sheet being as low in elasticity as the recording sheet.

17. The image forming apparatus according to claim 1, wherein a portion of the first guiding member configured to guide the recording sheet is disposed opposite to the second guiding member and faces away from the conveying surface of the belt.

18. The image forming apparatus according to claim 1, further comprising:

a main body casing formed with a manual feed side paper feed path on the upstream end of the second guiding member along the conveying direction of the recording sheet, wherein the conveying unit comprises;

a conveying roller disposed on the upstream end of the second guiding member along the conveying direction of the recording sheet and configured to convey the recording sheet to the belt; and a paper dust removing roller disposed on an upstream end of the first guiding member along the conveying direction of the recording sheet, and wherein a feed-out direction of the recording sheet from the conveying roller is a direction between a sheet inserting direction into the manual feed side paper feed path and the feed-out direction of the recording sheet from the paper dust removing roller.

19. The image forming apparatus according to claim 1, wherein the first guiding member is integrally provided with the second guiding member.

* * * * *